US006481703B2

(12) United States Patent
Yoshida et al.

(10) Patent No.: US 6,481,703 B2
(45) Date of Patent: Nov. 19, 2002

(54) IMAGE FORMING APPARATUS WITH HIGHLY OPERABLE SHEET DISCHARGE DEVICE

(75) Inventors: Akinori Yoshida, Aichi-ken (JP); Motomi Takemoto, Osaka (JP); Koji Naito, Osaka (JP); Hiroaki Ikeda, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/899,217

(22) Filed: Jul. 6, 2001

(65) Prior Publication Data

US 2001/0040332 A1 Nov. 15, 2001

Related U.S. Application Data

(62) Division of application No. 09/293,667, filed on Apr. 16, 1999, now Pat. No. 6,279,892.

(30) Foreign Application Priority Data

Apr. 17, 1998 (JP) ..... 10-107789
Jun. 17, 1998 (JP) ..... 10-170068

(51) Int. Cl.[7] ..... B65H 39/00

(52) U.S. Cl. ..... 270/58.08; 270/58.14; 270/58.18; 270/58.33; 399/76; 399/407; 707/909

(58) Field of Search ..... 270/58.08, 58.14, 270/58.18, 58.2, 58.33, 58.34, 58.02; 707/909; 364/478.11, 478.2, 478.16; 399/76, 79, 80, 407, 408, 410

(56) References Cited

U.S. PATENT DOCUMENTS 5,342,034 A * 8/1994 MAndel et al. ..... 270/58.08
5,971,383 A * 10/1999 Horikawa et al. ..... 270/58.08
6,082,725 A * 7/2000 Shinno et al. ..... 270/58.14

* cited by examiner

*Primary Examiner*—H. Grant Skaggs
(74) *Attorney, Agent, or Firm*—Morrison Foerster LLP

(57) ABSTRACT

An image forming system includes a digital copy machine to form an image on a group of sheets from an image of a group of documents, and a staple sorter sorting and discharging copied sheets from the digital copy machine. According to the staple sorter, control is provided so that a sheet of a long left period of time is transported from the bin to a nonsort tray when all of a plurality of bins provided in the staple sorter are used during a print operation. The left time of a sheet is monitored even when a print operation is not carried out. When the left time exceeds a predetermined time, control is provided so that the sheet left in the bin is transferred to the nonsort tray. As a result, a sheet discharge device is provided improved in operability of sheet discharge.

4 Claims, 25 Drawing Sheets

FIG. 12

BIN INFORMATION MANAGEMENT TABLE

| BIN | DISCHARGED SHEET | LEFT TIME | USER |
|---|---|---|---|
| 1 | PRESENT | 30 SECONDS | ID1 |
| 2 | NONE | 0 SECOND | NONE |
| 3 | PRESENT | 3600 SECONDS | ID3 |
| 4 | NONE | 0 SECOND | NONE |
| 5 | NONE | 0 SECOND | NONE |

FIG. 14

USER INFORMATION MANAGEMENT TABLE

| USER ID | PRIORITY |
|---|---|
| 1 | 1 |
| 2 | 2 |
| 3 | 2 |
| 4 | 2 |
| 5 | 1 |
| •<br>• | |

FIG. 15

BIN INFORMATION MANAGEMENT TABLE

| BIN | PRESENCE OF SHEET | STAPLE STATE | SHEET SIZE | OUTPUT NUMBER | JOB ID | USER ID |
|---|---|---|---|---|---|---|
| 1 | PRESENT | NO | A4Y | 20 | 1 | 1 |
| 2 | PRESENT | NO | A4Y | 20 | 1 | 1 |
| 3 | PRESENT | NO | A4T | 50 | 2 | 2 |
| 4 | PRESENT | NO | A3 | 10 | 3 | 1 |
| 5 | PRESENT | YES | A4Y | 30 | 4 | 3 |

FIG.26

USER INFORMATION MANAGEMENT TABLE

| USER ID | DISCHARGE SET BIN |
|---|---|
| 1 | 1 |
| 2 | 3 |
| 3 | 3 |
| •<br>• | |

FIG.28

BIN INFORMATION MANAGEMENT TABLE

| BIN | NUMBER OF SHEETS | JOB ID |
|---|---|---|
| NONSORT TRAY | 100 | |
| 1 | 50 | 1 |
| 2 | 10 | 2 |
| 3 | 0 | 3 |
| 4 | 0 | 3 |
| 5 | 0 | 3 |

IMAGE FORMING APPARATUS WITH HIGHLY OPERABLE SHEET DISCHARGE DEVICE

This application is based on Japanese Patent Application Nos. 10-107789 and 10-170068 filed in Japan, the contents of which are hereby incorporated by reference.

BACKGROUND OF THE INVENTION

The present invention relates to a sheet processing device to sort and discharge a sheet on which an image is formed, and an image forming system including this sheet processing device and an image forming apparatus.

DESCRIPTION OF RELATED ART

In an image forming apparatus including a conventional sheet processing device, there are cases when a plurality of users share one printer. In order to prevent a subsequent printed sheet from being mixed up at the sheet discharge unit, a sensor is provided to detect the presence of a sheet corresponding to each of a plurality of discharge bins to select an appropriate discharge bin to discharge a sheet.

Such a printer is limited in the number of the discharge bins. When a sheet is discharged and left at all the discharge bins, discharge of another sheet will cause that sheet to be mixed up with the sheet already left on any of the discharge bins.

As an image forming apparatus including such a sheet processing device, the technique disclosed in Japanese Patent Laying Open Nos. 8-9169, 6-92538, and 8-20457 is known.

According to the technique disclosed in Japanese Patent Laying-Open No. 8-9169, a sheet will be discharged to a particular discharge unit when all the discharge bins have sheets output therein. However, the problem of a newly output sheet being mixed up with the sheet left on the discharge bin will not be solved. This is inconvenient for the user. The operability in discharging a sheet is not satisfactory.

According to the technique disclosed in Japanese Patent Laying-Open Nos. 6-92538 and 8-20457, the position of the discharge bin is shifted to the left and the right to easily identify the interval between a job (one set of a series of printing process for a group of original documents). However, such a structure will increase the cost, and mixture of the discharge sheets cannot be avoided even when the output sheets are shifted and mounted for every job at the discharge bin. Furthermore, the interval between the jobs cannot be easily detected at a glance even when shifting is carried out on the discharge bins arranged in the vertical direction. This may cause the user inconvenience. The operability in discharging a sheet is not of the satisfactory level.

It is to be noted that the capacity of storing sheets in the bin of the sheet output device (bin capacity) is limited. The sheet output must be suppressed during the operation when the bin capacity has come to its limit.

A sheet output device is proposed to continue the sheet output at another bin when the capacity of the current bin arrives at its limit. When sheets are output into separate plurality of bins, there is a possibility that not all the sheets may be collected. The user may forget about the other sheets in another bin. There is a problem that, not only the operability of the user specifying the current sheet output, but also the operability of other users, will be degraded.

SUMMARY OF THE INVENTION

In view of the foregoing, an object of the present invention is to provide a sheet processing device improved in operability, connected to an image forming apparatus.

Another object of the present invention is to prevent sheets discharged corresponding to a plurality of image forming jobs, if any, from being mixed up at the discharge unit in a sheet processing device connected to an image forming apparatus.

A further object of the present invention is to prevent a discharged sheet of another job from being mixed up when the number of the sections where sheets are discharged corresponding to a plurality of image forming jobs, if any, is limited and all the sections are occupied by one job in a sheet processing device connected to an image forming apparatus.

Still another object of the present invention is to provide a sheet processing device improved in operability.

A still further object of the present invention is to provide an image forming system including an image forming apparatus and a sheet discharge device connected thereto and improved in operability.

The above objects can be achieved by a sheet processing device that processes a discharge sheet.

According to an aspect of the present invention, a sheet processing device which processes sheets discharged from an image forming apparatus executing a print job, includes: a first discharge tray; a plurality of second discharge trays; a plurality of sensors which detects whether there is a sheet on each of the plurality of second discharge trays, a transport unit which transports a bundle of sheets from the second discharge tray to the first discharge tray; and a controller which controls the transport unit so that, when detection is made of a sheet on all the second discharge trays by the sensor at the time of discharging a sheet by a new job, at least one of second discharge trays is selected according to a predetermined condition to transport a bundle of sheets from the selected second discharge tray.

When the sensor detects that sheets are discharged at all the plurality of second discharge trays in the event of discharging a sheet according to a new process job, a second discharge tray is selected according to a predetermined condition. The sheet already discharged on the selected second discharge tray is transported onto the first discharge tray. The sheet output from the new process job is discharged onto the second discharge tray from which the sheet has been removed.

Accordingly, a second discharge tray on which a sheet is not placed is prearranged. A sheet is discharged corresponding to the new job onto the prearranged second discharge tray. Therefore, the sheet output corresponding to a new job will not be mixed up at the discharge tray. Thus, the operability of the device is improved.

According to another aspect of the present invention, a sheet processing device includes: a first discharge tray; a plurality of second discharge trays; a plurality of timers which count the time of a bundle of sheets left on each of the plurality of second discharge trays; a transport unit which transports the bundle of sheets discharged on the second discharge tray to the first discharge tray; and a controller which controls the transport operation of the transport unit according to the count result of the timers. The bundle of sheets discharged on the second discharge tray is transported to the first discharge tray according to the time of the bundle of discharged sheets left at the plurality of second discharge trays. As a result, the bundle of sheets left for a long period are discharged to the first discharge tray, and the second discharge tray is prepared for a new job.

According to a further aspect of the present invention, a sheet processing device which processes sheets discharged from an image forming apparatus that executes a print job, includes: a memory which stores identification information of a user requesting a job corresponding to a plurality of jobs; a first discharge tray; a plurality of second discharge trays; a transport unit which transports to the first discharge tray a bundle of sheets discharged on the second discharge tray; and a controller which controls the transport unit so that a bundle of sheets of a previous job is transported from a second discharge tray when the user of a new job differs from the user of the previous job at the time of discharging a sheet by the new job to that second discharge tray from which the sheet of the previous job has been discharged.

When a sheet according to a newly processed job is to be discharged onto a second discharge tray in which a sheet is already discharged according to the detection by the sensor, the sheet according to the newly processed job is discharged onto the second discharge tray on which a sheet is already discharged when the user processing the new job is the same user processing the previous job corresponding to the sheet already discharged on the second discharge tray, and the sheet already discharged on the second discharge tray is transported to the first discharge tray so that the sheet according to the newly processed job is discharged onto that second discharge tray from which the sheet has been removed by the transportation when the user processing the new job differs from the user processing the previous job corresponding to the sheet already discharged on the second discharge tray.

Thus, a second discharge tray on which no sheet is placed is prearranged. A sheet corresponding to a new job is discharged onto the prearranged second discharge tray. The sheet output corresponding to the new job will not be mixed up at the discharge sheet unit. Thus, the operability of the device is improved.

According to still another aspect of the present invention, a sheet processing apparatus includes: a first discharge tray; a plurality of second discharge trays; a detector which detects a state that a sheet cannot be discharged to at least one of the plurality of second discharge trays; a transport unit which transports a bundle of sheets discharged on the second discharge tray to the first discharge tray; and a controller which controls the transport operation of the transport unit according to a detect result of the detector.

Detection such as capacity overflow is made for at least one of the plurality of second discharge trays. A sheet is transported to the first discharge tray according to the detection. Thus, a sheet processing device improved in operability can be provided.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 12 shows a bin information management table stored in a RAM.

FIG. 14 shows a user information management table stored in a RAM produced by the CPU that controls a staple sorter of an image forming system according to a second embodiment of the present invention.

FIG. 15 shows a bin information management table stored in a RAM produced by the CPU that controls the staple sorter.

FIG. 26 shows a user information management table stored in a RAM produced by the CPU that controls a staple sorter of an image forming system according to a third embodiment of the present invention.

FIG. 28 specifically shows a bin information management table according to a fourth embodiment of the present invention.

DESCRIPTION OF THE PREFERRED EMBODIMENTS

An image forming system including a staple sorter and a digital copy machine connected to the staple sorter according to embodiments of the present invention will be described hereinafter with reference to the drawings.

First Embodiment

Figure 1:
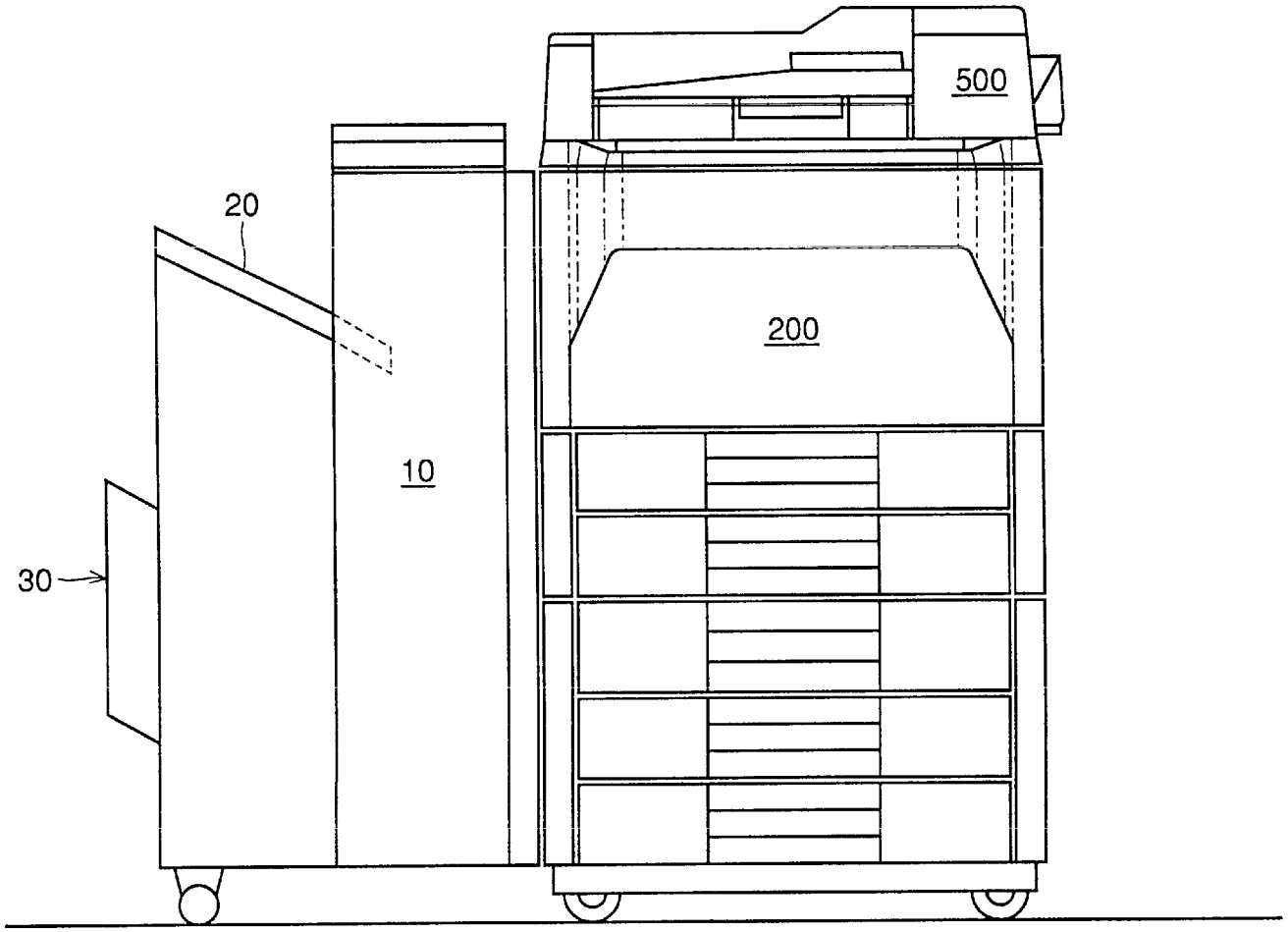
FIG. 1 schematically shows an entire structure of an image forming system including a staple sorter and a digital copy machine connected to the staple sorter according to a first embodiment of the present invention.

FIG. 1 is a diagram to describe an entire structure of an image forming system including a staple sorter 10 and a digital copy machine 200 connected to staple sorter 10 according to a first embodiment of the present invention.

In digital copy machine 200, an operation of a user is input via an operation panel 150 (refer to FIGS. 2 and 3) in forming an image. In response to a user input, a circulation type automatic document transport device 500 mounted on digital copy machine 200 feeds out one document at a time of one group of documents placed on a predetermined document supply tray onto a glass platen. When an exposure process is applied on the document on the glass platen, document transport device 500 discharges the document on the platen glass sequentially onto a document discharge tray.

Figure 2:
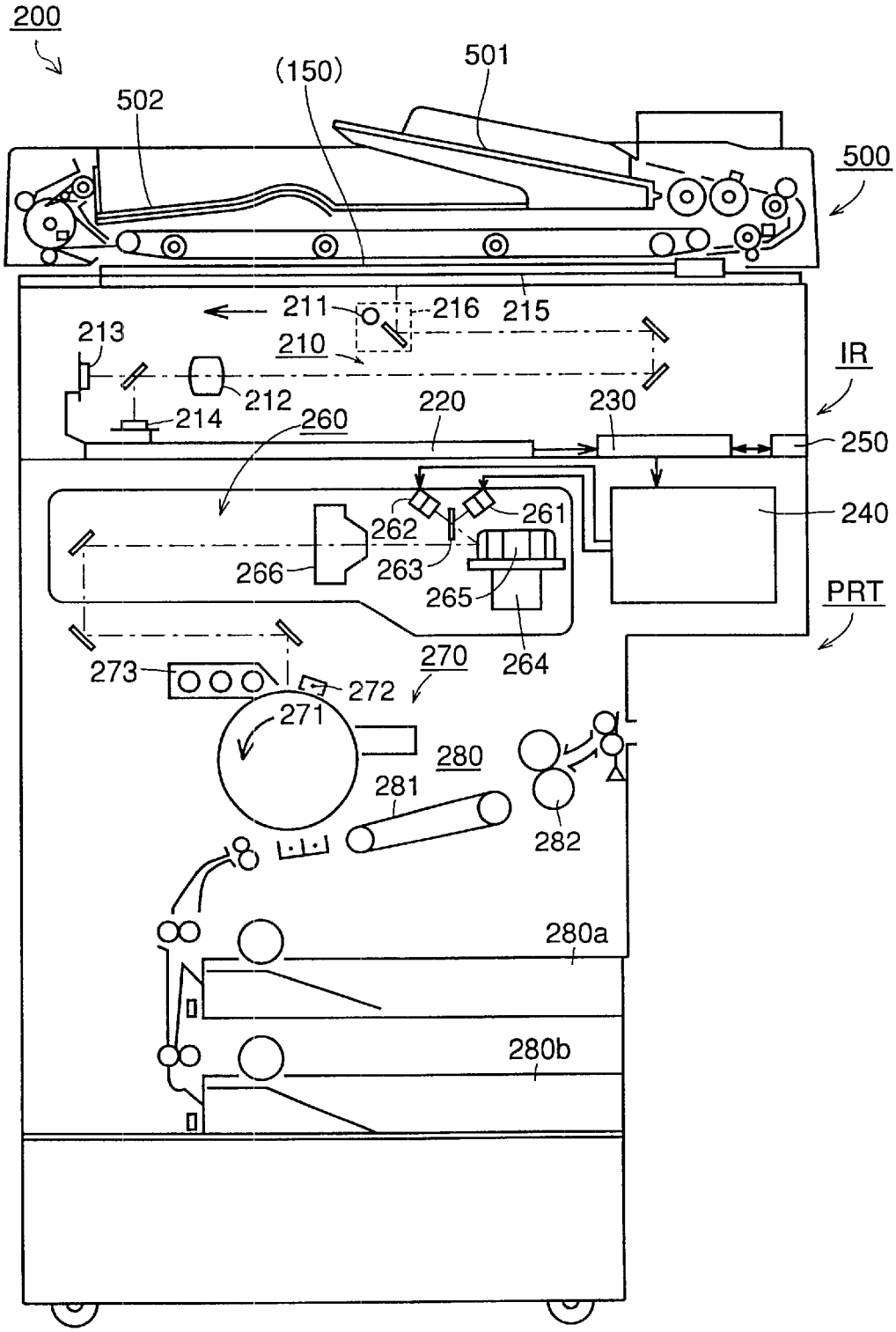
FIG. 2 is a schematic sectional view of a structure of a digital copy machine.

As shown in FIG. 2, digital copy machine 200 forms an image on a sheet from the image of a document read by an exposure process according to electrophotography. The sheet on which an image is formed is transferred to staple sorter 10 to be discharged on a nonsort tray 20 of staple sorter 10 or on a discharge bin of a bin assembly 30.

Referring to FIG. 2, digital copy machine 200 is constituted mainly by an automatic document transport device 500 transporting a document and inverting the front and back side of a document, if necessary, a reader IR reading out an image of a document to generate image data, a memory unit 230 temporarily storing image data obtained by reader IR, a printer device PRT printing out on a copy sheet according to the image data stored in memory unit 230, an operation panel 150 (provided at the top plane of digital copy machine 200 (vertical direction in the drawing) to enter an operation, and an external input/output control unit 250 to input/output data.

When a print operation is designated at automatic document transport device 500, the document set on a document supply tray 501 is set at the readout position on glass platen 215 automatically starting from the bottom sheet of documents. When the reading operation by reader IR is completed, the document is discharged on discharge tray 502.

Reader IR includes a scanning system 210 and an image signal processor 220. At scanning system 210, the image of the document set at the read position is exposed by an exposure lamp 211 attached to a scanner 216 that travels below the document. The reflected light from the document passes through a reflection mirror and a condenser lens 212 to enter photoelectric conversion elements 213 and 214 employing a CCD array and the like. The signal obtained by scanning system 210 is sent to image signal processor 220. Image signal processor 220 applies various image processes on the input signal such as binalization, picture quality correction, variable scale magnification, and image editing. The image data subjected to the image process is stored in memory unit 230.

Printer device PRT includes a print processor 240, an optical system 260, an image forming system 270, and a sheet transport system 280. Print processor 240 drives optical system 260 according to the image data from memory unit 230. At optical system 260, semiconductor lasers 261 and 262 emit a laser beam respectively according to the signal under control of print processor 240. The laser beams are combined at a dichroic. mirror 263 and reflected by a polygon mirror 265 that is rotated by a motor 264. The reflected beam passes through a main lens 266 to be directed to a photoconductor 271 of image forming system 270.

At image forming system 270, photoconductor 271 is charged by a corona charger 272. Then, the laser beam from optical system 260 is directed thereto. Accordingly, an electrostatic latent image is formed on photoconductor 271. Then, toner is placed on the electrostatic latent image by a developing device 273. The toner image on photoconductor 271 is transferred onto a copy sheet fed from a sheet feed cassette 280*a* or a sheet feed cassette 280*b* of sheet transport system 280. The sheet is then delivered to a fixer 282 by a sheet feed transport belt 281. The toner is fixed on the sheet by heat and pressure. Then, the sheet is discharged towards a pair of input rollers 81 of staple sorter 10 (refer to FIG. 4) connected to digital copy machine 200.

External input/output control unit 250 transfers data between a local network (LAN) and a public telephone line (PSTN). External input/output control unit 250 includes a facsimile converter to transmit/receive data to/from memory unit 230 in a facsimile operation mode to carry out conversion of the pixel density, coding method and the like, a G3 unit providing communication control such as modulation and demodulation of image data and control signals in a facsimile operation mode and also connected to a telephone line for communication control with a PSTN, and a network controller connected to a LAN to provide network control for transferring control signals and image data with an external device connected to the LAN.

Figure 3:
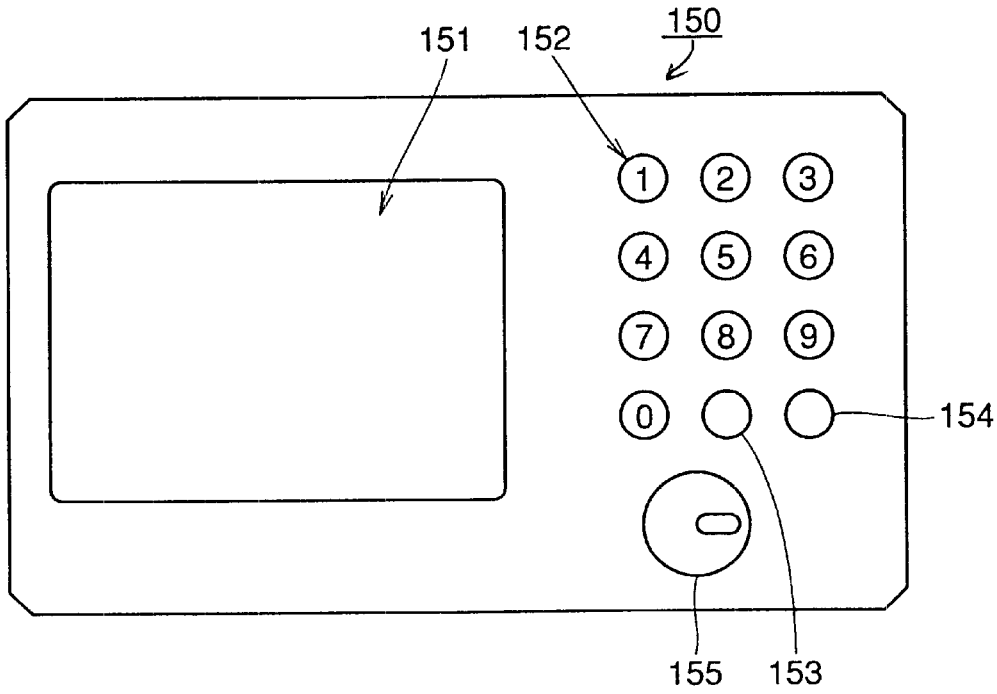
FIG. 3 is a plan view of a structure of an operation panel 150 provided at a top plane of a digital copy machine.

FIG. 3 is a plan view to describe the structure of operation panel 150 on the top plane of digital copy machine 200.

Operation panel 150 includes a touch panel 151 on which the copy condition and the internal status of digital copy machine 200 are displayed by liquid crystal, and through which a predetermined operation can be input to set the copy condition and the like, a ten key 152 to input numerics of the number of copies, the copy scale rate and the like, a reset key 153 to reset the copy condition specified by the user, an interrupt key 154 to interrupt the current process, and a start key 155 to designate initiation of the copy operation.

Figure 4:
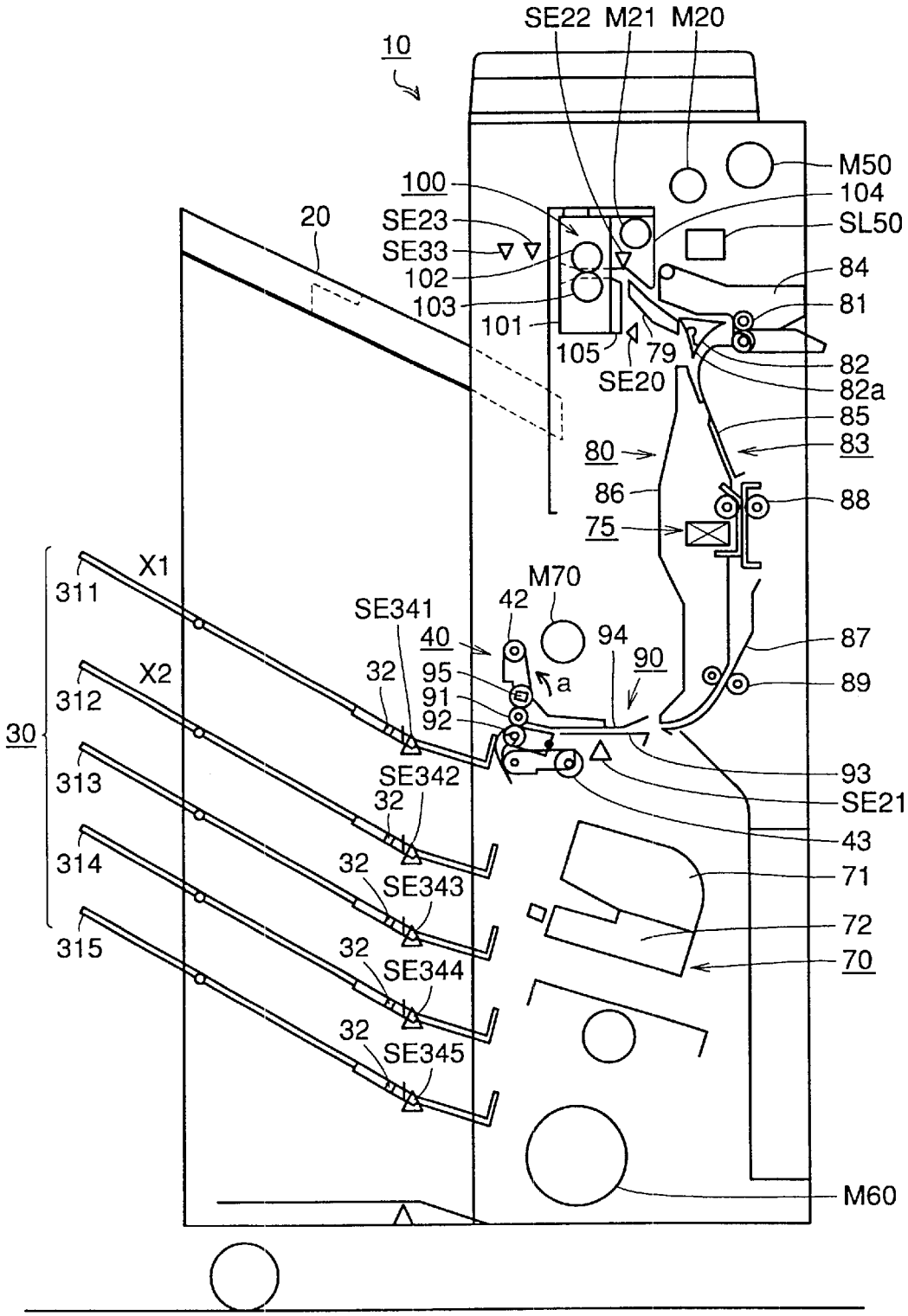
FIG. 4 is a diagram to describe a structure of a staple sorter.
Figure 5:
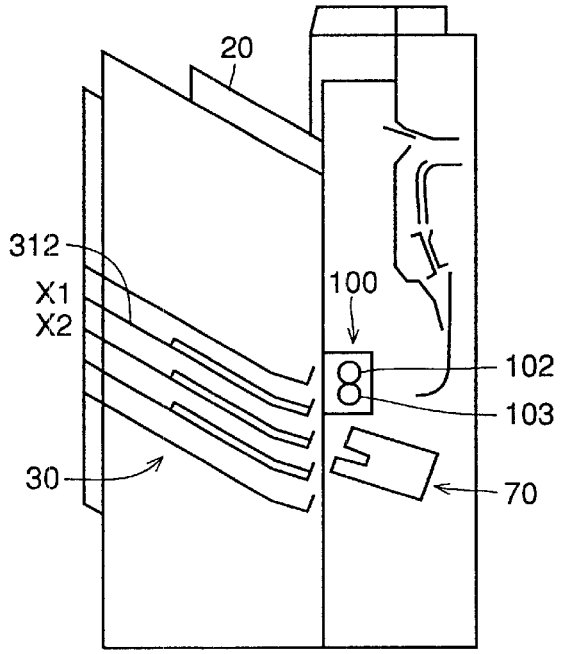
FIGS. 5, 6, 7, 8, 9 and 10 are diagrams to describe the movement of a sheet bundle transport gate in a staple sorter.
Figure 6:
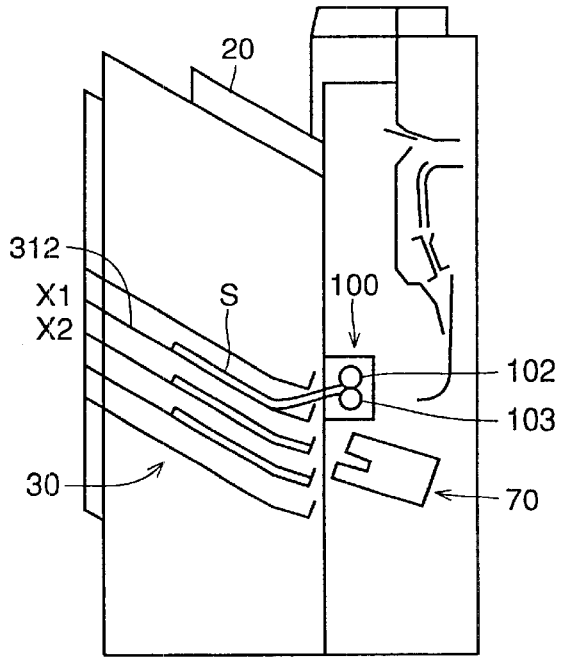
Figure 7:
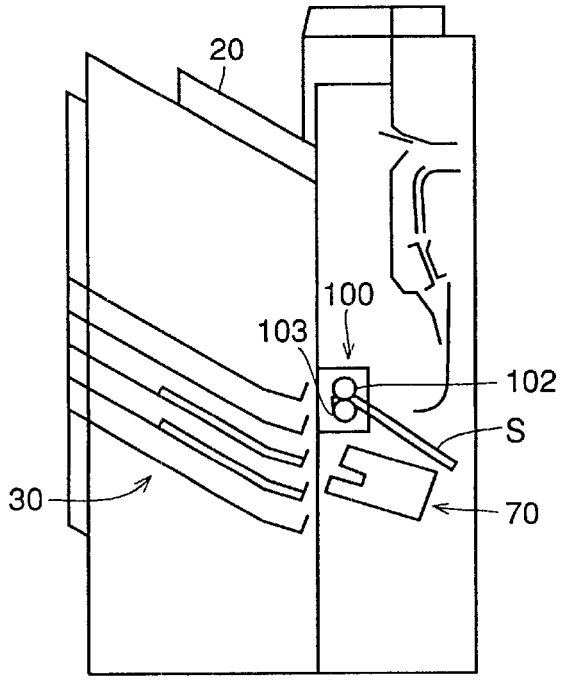
Figure 8:
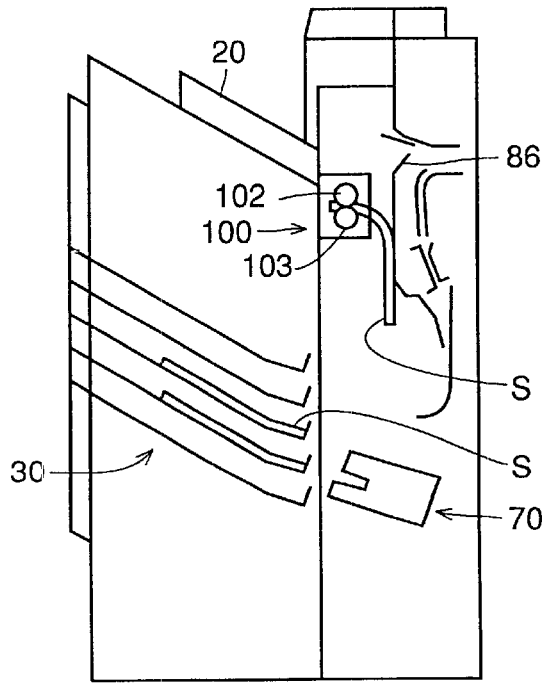
Figure 9:
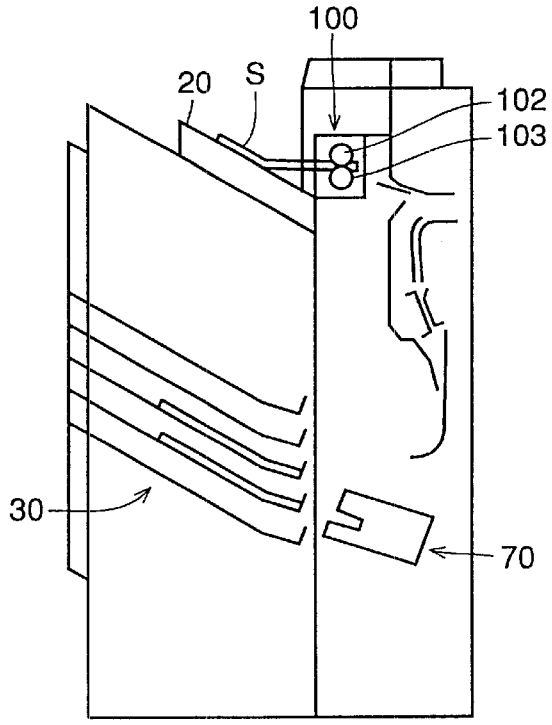
Figure 10:
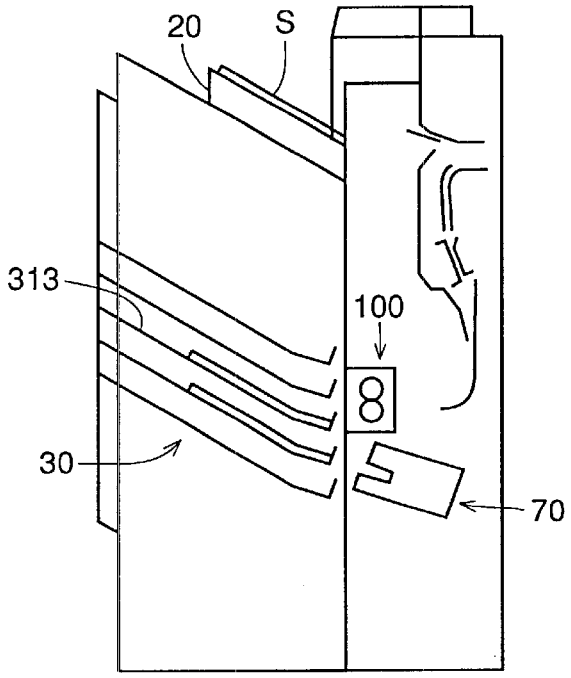

FIG. 4 is a diagram to describe the internal structure of staple sorter 10.

Staple sorter 10 includes a sheet transport unit 80, a bin assembly 30 of five stages of discharge bins 311–315 (referred to as bins 315–335 hereinafter), a staple unit 70 for stapling a bundle of sheets, if necessary, a remove unit 40 driven by a motor M70 to deliver the bundle of sheets on bins 311–315 to a sheet bundle transport gate 100 for removal, a nonsort tray 20, and sheet bundle transport gate 100 transporting the bundle of sheets removed from bins 311–315 by remove unit 40 onto nonsort tray 20.

The following description is mainly focused on sheet transport unit 80, bin assembly 30, staple unit 70 and sheet bundle transport gate 100 with reference to FIG. 4.

Sheet transport unit 80 includes a roller pair 81 to receive a sheet discharged from digital copy machine 200 (refer to FIG. 1), a first transport unit 83 to transport a sheet in substantially a vertical direction, a switching claw 82 to switch the sheet transport direction towards first transport unit 83 or sheet bundle transport gate 100, and a second transport unit 90 to transport the sheet from first transport unit 80 towards bin assembly 30 in a substantially horizontal direction.

Here, switching claw 82 can be made to rotate about a support shaft 82*a* according to the ON/OFF of a solenoid SL50.

When solenoid SL50 is off, switching claw 82 is set at the position shown in FIG. 4. In this case, the sheet discharged from digital copy machine 20 and received by input roller pair 81 is guided by the curved light surface of switching claw 82 to be sent to first transport unit 83.

When solenoid SL50 is on, switching claw 82 rotates clockwise from the position shown in FIG. 4. In this case, the sheet discharged from digital copy machine 200 and received by roller pair 81 is guided on the upper surface of switching claw 82 by a guide plate 79 to be transported to nonsort tray 20 through sheet bundle transport gate 100.

First transport unit 83 includes guide plates 84–87 to guide the sheet, transport roller pairs 88 and 89 to transport a sheet. A punch unit 75 is arranged at the middle stage portion to form a binding hole at the leading end or trailing end in the transportation direction of the sheet. Second transport unit 90 includes a pair of transport rollers 91 and 92 to transport a sheet, and guide plates 93 and 94 to guide a sheet. Guide plate 94 is attached to the side plate portion of guide plate 93. Transport roller 91 is attached to one end of guide plate 94. Second transport unit 90 can be moved about a support shaft 95 approximately 90° in the direction of arrow a from the position shown in FIG. 4.

In staple sorter 10, second transport unit 90 takes the position shown in FIG. 4 when sheets are distributed towards bins 311–315. The sheet delivered from first transport unit 83 by transport rollers 91 and 92 is sent towards bin assembly 30. Second transport unit 90 rotates substantially 90° in the direction of arrow a about support shaft 95 to be withdrawn from the sheet transport position when a bundle of sheets from bins 315–316 are to be output on nonsort tray 20.

A sensor SE21 is arranged at second transport unit 90. Sensor SE21 senses the sheet stored in bins 311–315 and the bundle of sheets removed from bins 311–315.

Input roller pair 81, transport roller pairs 88 and 89, transport rollers 91 and 92, and remove rollers 42 and 43 of remove unit 40 to deliver the bundle of sheets to sheet bundle transport gate 100 in removing the bundle of sheets from bins 311–315 are rotated by a driving force transmission means not shown by a motor M50.

Bin assembly 30 includes five stages of bins 311–315. Each of bins 311–315 is arranged at a constant interval in a slanted manner. A pin 32 provided at the lower end side of each of bins 311–315 engages with a spiral groove formed at the outer perimeter of a drive shaft not shown provided in the vertical direction. The drive shaft is rotated in one direction or the opposite direction by a motor M60 to raise/lower each of bins 311–315.

Bin assembly takes the home position shown in FIG. 4. In this home position, first bin 311 faces transport rollers 91 and 92. Second bin 312 faces staple unit 70. The position of bins 311–315 corresponding to transport rollers 91 and 92 is referred to as position X1 hereinafter. The position of bins 311–315 corresponding to staple unit 70 is referred to as position X2 hereinafter.

When the drive shaft is contrarotated once from the state where first bin 311 takes position X1, first bin 311 is lowered to position X2 and second bin 312 is lowered to the position in contact with third bin 313. The bundle of sheets on first bin 311 can be bound by staple unit 70 when first bin 311 takes position X2. When the drive shaft is rotated once in the positive direction after the bundle of sheets are stapled, first bin 311 is elevated to position X1 and second bin 312 is elevated to position X2. The stapled sheets on first bin 311 are removed by the user with first bin 311 at position X1.

Bin assembly 30 is provided with a sensor (not shown) to detect that each of bins 311–315 is set at the home position, and a sensor (not shown) to detect that each of bins 311–315 is elevated by one pitch at one turn of the drive shaft. Sensors SE341–S345 are attached to each of bins 311–315 to detect the presence of a sheet.

At staple sorter 10 of the present embodiment, the position of distributing sheets to each of bins 311–315 and the position of removing a bundle of sheets are both the same position X1. The structure of the sorter unit is simplified by carrying out the storage and removal of a sheet at the same position.

Staple unit 70 is formed of the well known motor-operated structure. Staple unit 70 includes a head unit 71 with a detachable cartridge in which staples are set, and an anvil unit 72 to receive and bend a staple output from head unit 71. Staple unit 70 is moved towards bins 311–315 set at position X2 to drive in a staple at one corner or two staples at the end portion of a bundle of sheets.

Staple unit 70 can move towards the rear side with the front side of staple sorter 10 (the front side of the drawing) as the home position. Staple unit 70 temporarily stops at a predetermined position and then moves towards bins 311–315 to drive in a staple. Staple unit 70 returns to the home position following the drive-in of a staple. A notch is formed at the lower end portion of each of bins 311–315 where a staple is to be driven in, whereby the leading end of staple unit 70 can enter the bin side.

Sheet bundle transport gate 100 includes a pair of gate rollers 102 and 103 in a box 101, and sheet guide plates 104 and 105. Rollers 102 and 103 are rotated clockwise/counterclockwise by a motor M21. Sheet bundle transport gate 100 is guided by a guide member not shown to be elevated/lowered. A motor M20 is provided as a driving source thereof Sheet bundle transport gate 100 takes the home position shown in FIG. 4. At the home position, sheet bundle transport gate 100 delivers leftward in FIG. 4 a sheet guided on the top plane of switching claw 82 from roller pair 81 by means of rotation of rollers 102 and 103 towards nonsort tray 20.

Sheet bundle transport gate 100 can be shifted within staple sorter 10 as shown in FIGS. 5–10. FIGS. 5–10 are diagrams to describe the movement of sheet bundle transport gate 100 within staple sorter 10.

Sheet bundle transport gate 100 is lowered down to the position facing bin 312 set at position X2 (refer to FIG. 5) to receive a bundle of sheets that are stapled/not stapled on bin 312. At this remove position, sheet bundle transport gate 100 sandwiches a bundle of sheets S by means of rollers 102 and 103 (refer to FIG. 6) output from bin 312 by the shift of remove rollers 42 and 43 of FIG. 4. Sheet bundle S is received by sheet bundle transport gate 100 by the positive rotation of rollers 102 and 103 (refer to FIG. 7).

Upon complete input of sheet bundle S in sheet bundle transport gate 100, the positive rotation of rollers 102 and 103 stops. At the same time, sheet bundle transport gate 100 is elevated (refer to FIG. 8). When sheet bundle transport gate 100 uses to a predetermined height, rollers 102 and 103 contrarotate to discharge the sandwiched sheet bundle S on nonsort tray 20 (refer to FIG. 9). Then, sheet bundle transport gate 100 is raised one pitch and lowered down to the remove position facing bin 313 set at position X1 (refer to FIG. 10). A stacking operation to nonsort tray 20 can be repeated as described above.

To enable the stacking operation, a sensor SE33 to detect presence of a sheet on nonsort tray 20 and a sensor SE23 to detect the top most surface of the sheets on nonsort tray 20 (the upper surface of nonsort tray 20 when there is no sheet) above nonsort tray 20 as shown in FIG. 4. Also are provided a sensor SE20 to detect that sheet bundle transport gate 100 is at the home position and a sensor SE22 to detect presence of a bundle of sheet within sheet bundle transport gate 100.

The stacking operation can be carried out concurrently with the staple process on the bundle of sheets on the bin set at position X2 in staple sorter 10.

Figure 11:
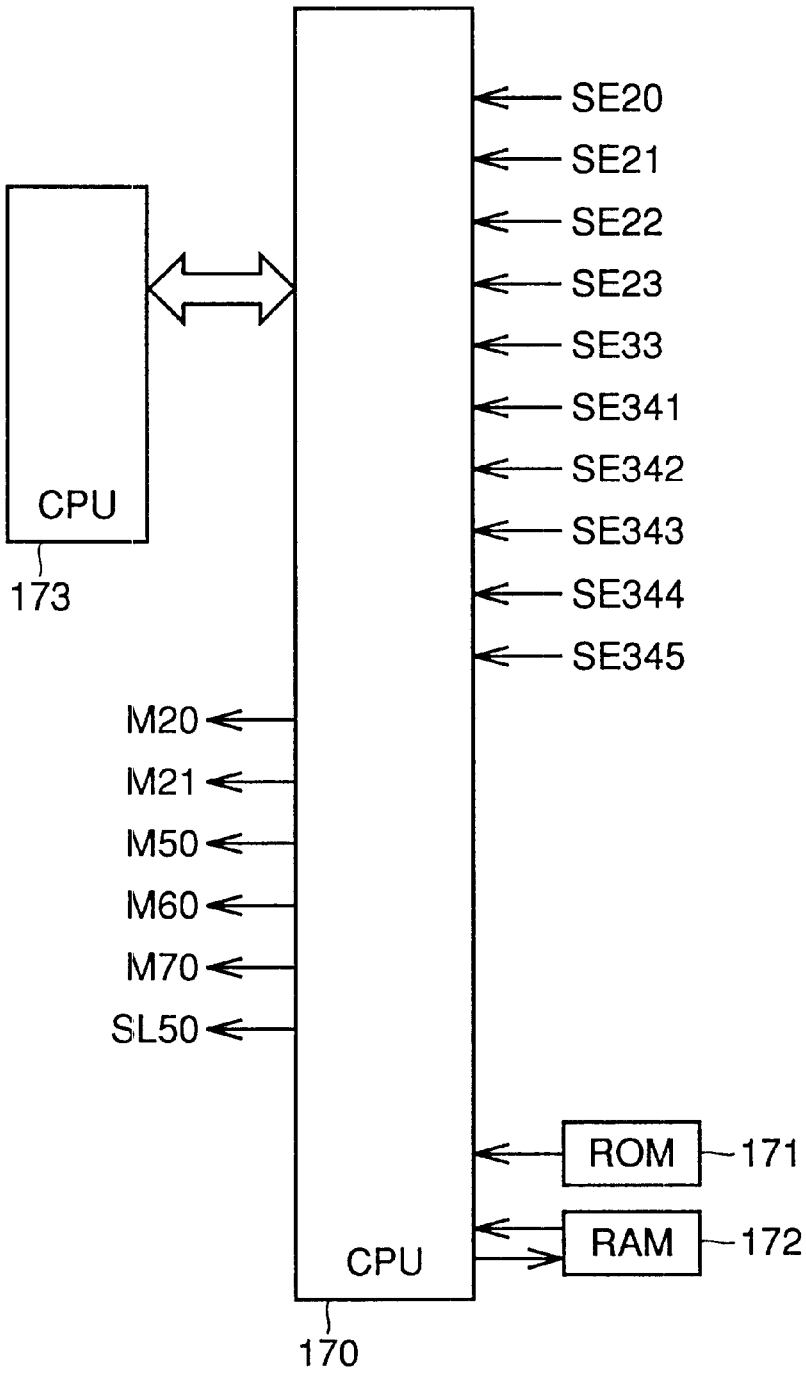
FIG. 11 is a block diagram showing a structure of a control unit controlling a digital copy machine and a staple sorter connected to the digital copy machine.

Digital copy machine 200 and staple sorter 10 of the above structure are under control of the control unit shown in FIG. 11.

FIG. 11 is a block diagram showing a structure of the control unit providing control of digital copy machine 200 and staple sorter 10 connected to digital copy machine 200.

The control unit includes a ROM 171 storing a program to operate staple sorter 10, a CPU 170 executing a program, a RAM 172 storing information required for program execution, and a CPU 173 controlling digital copy machine 200.

Various detection signals from sensor SE20 detecting that sheet bundle transport gate 100 is at the home position, sensor SE21 detecting presence of a bundle of sheets at second transport unit 90, sensor SE22 detecting presence of a bundle of sheets within sheet bundle transport gate 100, sensor SE23 detecting the top most face of the sheets on nonsort tray 20, sensor SE33 detecting presence of sheet on nonsort tray 20, and sensors SE341–SE345 detecting presence of a sheet on each of bins 311–315, respectively, shown in FIG. 4, are applied to CPU 170.

CPU 170 outputs respective drive signals to motor M20 moving sheet bundle transport gate 100 in the vertical direction, motor M21 to rotate rollers 102 and 103 in sheet bundle transport gate 100, motor M50 to drive various rollers in staple sorter 10, motor M60 to drive a shaft that moves each of bins 311–315 in the vertical direction, motor M70 to drive remove unit 40, and solenoid SL50 to drive switching claw 82 that switches the sheet transport direction.

A CPU 173 providing the control of various components (refer to FIG. 2) of reader IR of digital copy machine 200, memory unit 230, printer device PRT and operation panel 150 is connected to CPU 170. A signal requesting initiation of a print process is sent from CPU 170 to CPU 173. A signal indicating the end of a printing process is sent from CPU 173 to CPU 170. Signals are transferred between CPU 173 and CPU 170 to carry out a process at staple sorter 10 while adjusting the printing timing of an image onto a sheet at digital copy machine 200.

CPU 170 includes an internal counter to count the period of time of a sheet left on each bin.

According to staple sorter 10 of the above structure, a bin information management table as shown in FIG. 12 is generated by CPU 170 to be stored in RAM 172. Control according to the flow chart shown in FIG. 13 is provided using the bin information management table stored in RAM 172.

Referring to the bin information management table of FIG. 12, "bins 1–5" correspond to bins 311–315 (refer to FIG. 4), respectively. Detection is made whether a sheet is discharged at each of bins 1–5 by sensors SE341–SE345. The detected result is "present" and "none" of a discharged sheet. The "left time" indicates the period of time of each sheet left at bins 1–5. "User" indicates the user using respective bins 1–5. The user of bins 1–5 is identified by an ID card and the like that is inserted into a predetermined slot in which magnetic information is stored.

For example, it is appreciated that the sheet for the user of user ID3 is discharged and left for 3600 seconds on bin 3, according to the bin information management table.

Figure 13:
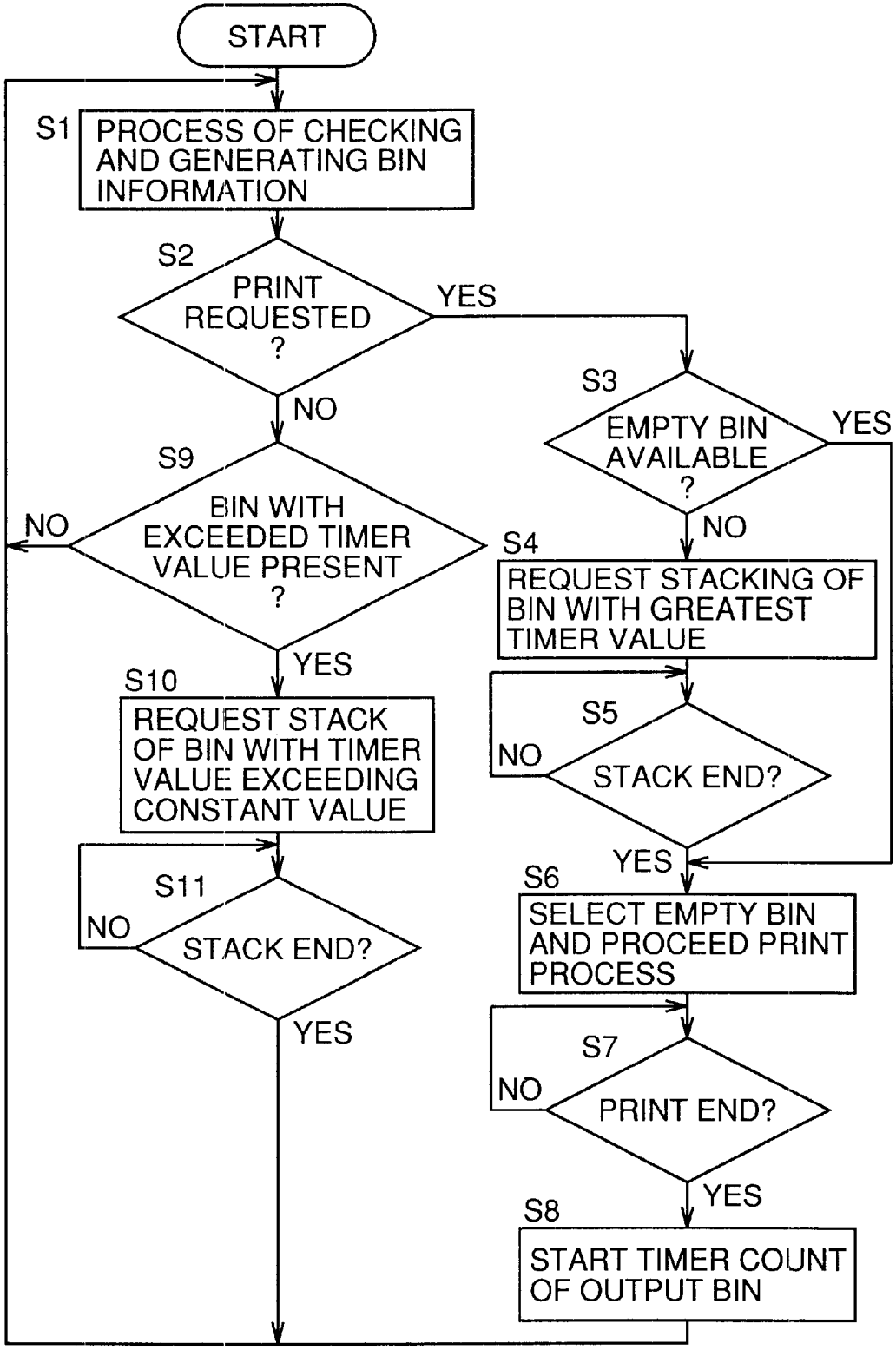
FIG. 13 is a flow chart showing the control procedure of a CPU at a staple sorter.

FIG. 13 shows a flow chart of the control procedure of CPU 170 (refer to FIG. 11) at staple sorter 10 (refer to FIG. 4).

When the power is turned on to start the program, the bin information is first checked by staple sorter 10 at step 1 ("step" abbreviated as S hereinafter) to generate a bin information management table as shown in FIG. 12. At S2, determination is made whether a print process request is detected from CPU 173 controlling digital copy machine 200.

When a print process request is detected (YES at S2), control proceeds to S3 to detect whether there is an empty bin (an unused bin) according to the bin information management table.

When there is no empty bin (NO at S3), control proceeds to S4 to identify the bin corresponding to the greatest timer value indicating the left time according to the bin information control table. The sheet discharged on the identified bin is delivered onto nonsort tray 20, as shown in FIGS. 5–10 (stack operation). At S5, determination is made the stacking operation has ended or not. When the stacking operation has not yet ended (NO at S5), control remains at S5. When the stacking operation has ended (YES at S5), control proceeds to S6 to select the available bin emptied by the stack operation. A print process initiate request signal is sent to CPU 173 that controls digital copy machine 200. Accordingly, the sheet subjected to a printing process is discharged onto the available bin emptied by the stack operation of staple sorter 10.

At S7, determination is made whether the print operation has ended or not. If the print process has not yet ended (NO at S7), the control remains at S7. When the print process has ended (YES at S7), control proceeds to S8 to initiate the timer counting of the bin corresponding to the ended print process. When the processes are completed, control returns to S1.

When there is an empty bin (YES at S3), control proceeds directly to S6, skipping the processes of S4 and S5. The bin determined to be empty at S3 is selected, and a print process initiated.

When a print process request is not detected (NO at S2), control proceeds to S9 to determine whether there is a bin having a timer value exceeding a predetermined time indicating the left time according to the bin information management table. When there is no bin corresponding to a timer value exceeding the predetermined time (NO at S9), control returns to S1. When there is a bin having a timer value exceeding the predetermined time (YES at S9), control proceeds to S10 to initiate a stack operation for the sheet on that bin. At S1, determination is made whether the stack operation has ended or not. When the stack operation has not yet ended (NO at S11), control remains at S11. When the stack operation has ended (YES at S11), control returns to S1.

Thus, sensors SE341–SE345 detecting the presence of a sheet at each of bins 311–315 are provided, and the period of time of the sheet left on each of bins 311–315 is counted. According to the counted time, the sheet on one of bins 311–315 with the longest left time is conveyed to nonsort tray 20 when all bins 311–315 are used in the event of a print operation. The left time of a sheet is monitored even when printing is not carried out. When the left time exceeds a predetermined time, the sheet on the bin corresponding to the value with the exceeded predetermined time is transferred to nonsort tray 20.

Thus, a bin on which a sheet is not placed is prearranged. A sheet corresponding to a new job is discharged on the prearranged bin. Therefore, the sheet output corresponding to the new job will not be mixed up in that the discharge unit. Thus, the user operability is improved.

Second Embodiment

An image forming system according to a second embodiment of the present invention will be described hereinafter. The image forming system of the second embodiment differs from the image forming system of the first embodiment in the control procedure of the staple sorter described with reference to FIGS. 12 and 13. The remaining elements are similar to those of the image forming system of the first embodiment.

According to the staple sorter of the image forming system of the second embodiment, a user information management table and a bin information management table shown in FIGS. 14 and 15 are generated by the CPU that controls the staple sorter. The tables are stored in the RAM connected to this CPU. Control according to the flow chart of the main routine of FIG. 16 and the flow chart of the subroutine shown in any of FIGS. 17–26 are executed using the user information management table and bin information management table.

FIG. 14 shows a user information control table formed by the CPU providing control of the staple sorter of the image forming system of the second embodiment and stored in a RAM. FIG. 15 shows a bin information management table generated by the CPU providing the control of the staple sorter and stored in a RAM.

Referring to the user information management table of FIG. 14, "priority" is assigned to a "user ID". A user ID is identified by an ID card and the like that is recorded with magnetic information and that is inserted into a predetermined insert slot, likewise the image forming system of the first embodiment. According to the user information management table, user ID3 has a priority of 2, which is higher in level than the priority of 1 for user ID5. The user priority of user ID3 is set lower than the user priority of user ID5.

The bin information management table of FIG. 15 is created according to the detected values of respective sensors and the input copy condition with respect to a job from the operation panel. "Bins 1–5" identify a plurality of bins provided at the staple sorter, such as the above bins 311–315. "Present" and "none" of the "presence of sheet" indicates whether a sheet is discharged in each of bins 1–5. "Sheet size" indicates the size of a sheet discharged at each of bins 1–5. "Output number" indicates the number of sheets discharged at each of bins 1–5. "Job ID" indicates which job relates to the sheets discharged at each of bins 1–5. "User ID" indicates the user corresponding to the sheet discharged at each of bins 1–5.

For example, twenty sheets of A4Y in size (T indicates that the longer side of a rectangular sheet is placed parallel to the sheet transport direction; Y indicates that the longer side of a rectangular sheet is placed perpendicular to the sheet transport direction), not stapled, are discharged on bin 2 by the bin information management table. The user ID corresponding to this sheet is 1, likewise to the sheet discharged on bin 1. Also, the user ID corresponding to this sheet is 1, likewise the sheets discharged on bins 1 and 4.

Figure 16:
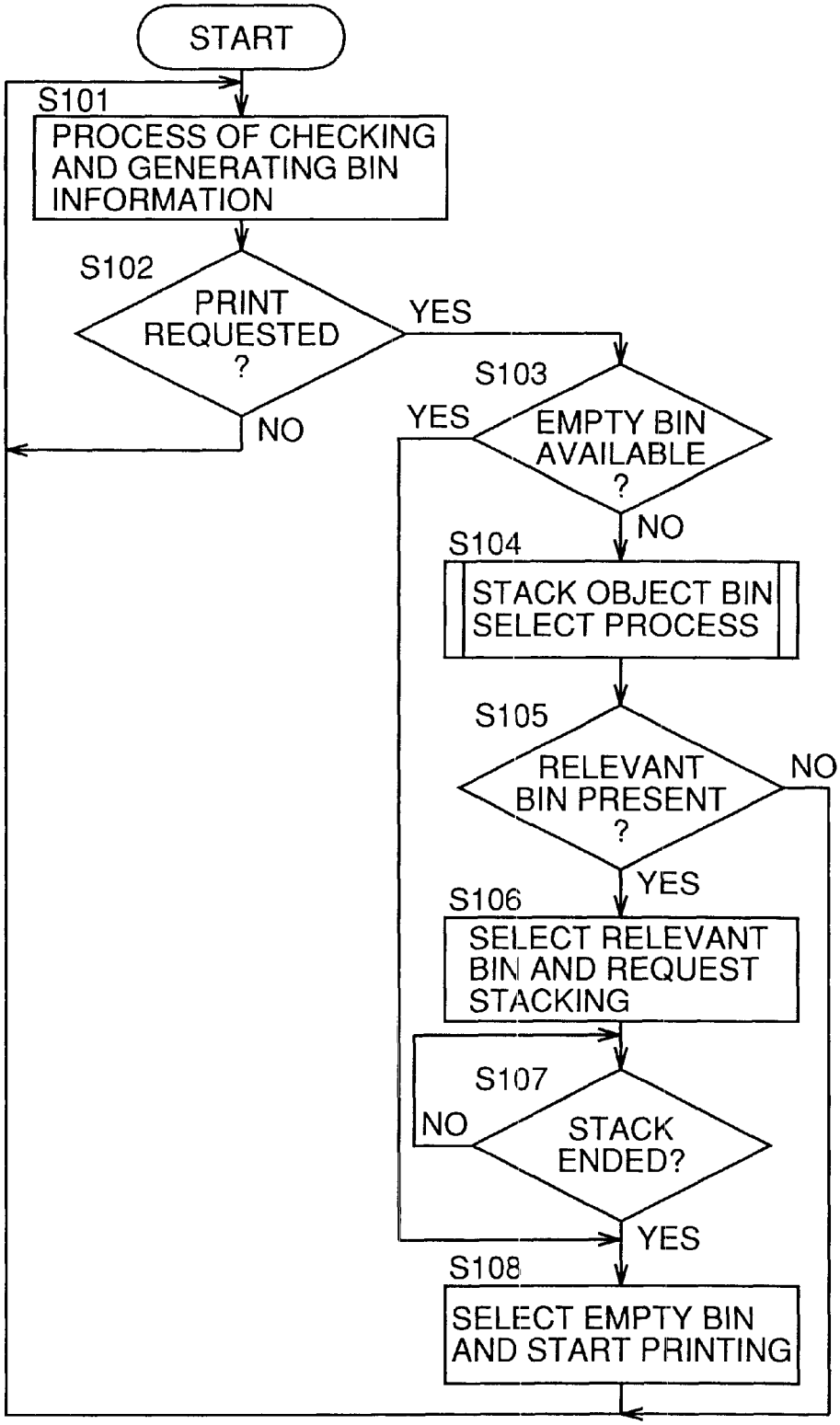
FIG. 16 is a flow chart showing the control procedure at the CPU that controls the staple sorter.

FIG. 16 is a flow chart showing the control procedure by the CPU providing control of the staple sorter.

When the power is turned on to start the program, the user information or the bin information is checked at S101 by the staple sorter. The user information management table and bin information management table as shown in FIGS. 14 and 15 are produced. At 102, determination is made whether a print process request is detected from the CPU providing control of the digital copy machine to which the staple sorter is connected.

When a print process request is not detected (NO at S102), control proceeds to S101. When a print process request is detected (YES at S102), control proceeds to S103 to determine whether there is an empty bin according to the bin information management table.

When there is no empty bin (NO at S103), control proceeds to S104. A stack object bin select process to select a bin that is subject to a stack operation is carried out by the subroutine shown in FIGS. 17–26. At S105, determination is made whether there is a bin relevant to the bin of interest selected at S104.

When there is no relevant bin (NO at S105), control proceeds to S101. When there is a relevant bin (YES at S105), control proceeds to S10G to select the relevant bin. Then, a stack operation is initiated. At S107, determination is made whether the stack operation has ended or not. When the stack operation has not yet ended (NO at S107), control remains at S107. When the stack operation has ended (YES at S107), control proceeds to S108 to select the available bin emptied by the stack operation. A signal requesting the start of a print process is sent to the CPU providing control of the copy machine. Accordingly, a sheet subjected to a print process is discharged on the available bin emptied by the stack operation by the staple sorter. Then, control returns to S101.

When there is an empty bin (YES at S103), control proceeds directly to S108, skipping the processes of S104–S107. The bin determined to be empty at S103 is selected, and a print operation is initiated.

The stack object bin select process of S104 of FIG. 16 will be described with reference to FIGS. 17–26. Although description is provided of a control using any one of the processes of FIGS. 17–26, a plurality of the processes of FIGS. 17–26 can be combined. Respective stack object bin select processes of FIGS. 17–26 are denoted as processes A, B, . . . to identify each stack object bin select process.

Figure 17:
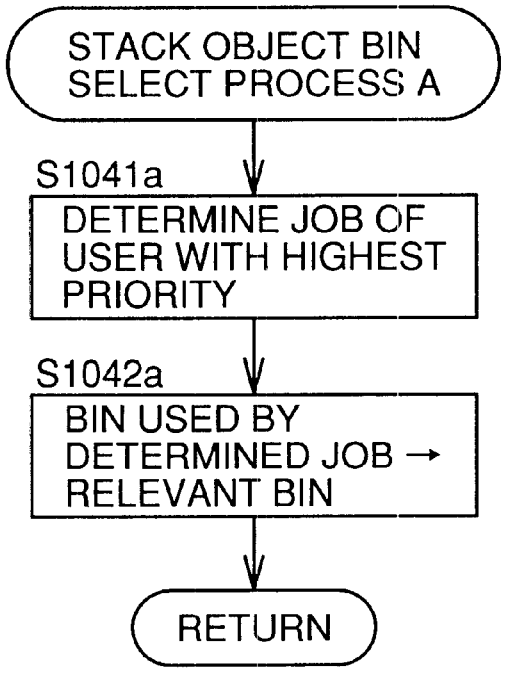
FIGS. 17, 18, 19, 20, 21, 22, 23, 24 and 25 are flow charts showing a select process A, B, C, D, E, F, G, H and I, respectively, of a bin for stacking.

FIG. 17 is a flow chart of a stack object bin select process A. The bin on which a sheet is discharged corresponding to the job of the user with the highest priority is selected as the bin of the subject of the stack operation.

At S1041*a*, the job of the user with the highest priority is determined according to the user information management table (refer to FIG. 14). At S1042*a*, the bin corresponding to the job determined at S1041*a* is selected as the relevant bin. Then, the present routine ends.

When there is a bin selected as the relevant bin in stack object bin select process A, the sheet on that relevant bin is taken as the subject of the stack operation (S106 of FIG. 16). By setting the priority of the user ID for the supervisor at a low level, the job of the supervisor will not be taken as the object of the stack operation. The sheet discharged on the bin by the job of the supervisor will not be transported to the nonsort tray (refer to FIGS. 5–10). There is no need to sort the sheets discharged in bundles from a plurality of bins.

Figure 18:
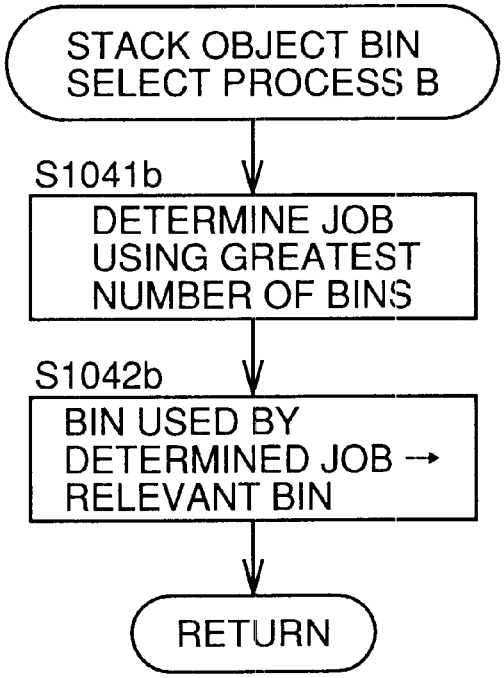

FIG. 18 is a flow chart of a stack object bin select process B. The bin on which a sheet is discharged by a job using the greatest number of bins is selected as the bin to be subjected to the stack operation.

At S1041*b*, the job using the greatest number of bins is determined according to "job ID" (refer to FIG. 15) in the bin information management table. At S1O42*b*, the bin used by the job determined at S1041*b* is selected as the relevant bin. Following these processes, the present routine ends.

When there is a bin selected as the relevant bin in stack object bin select process B, the sheet on that relevant bin is taken to be the object of the stack operation (S106 of FIG. 16). By the stack operation with respect to one job, more bins can be made available.

Figure 19:
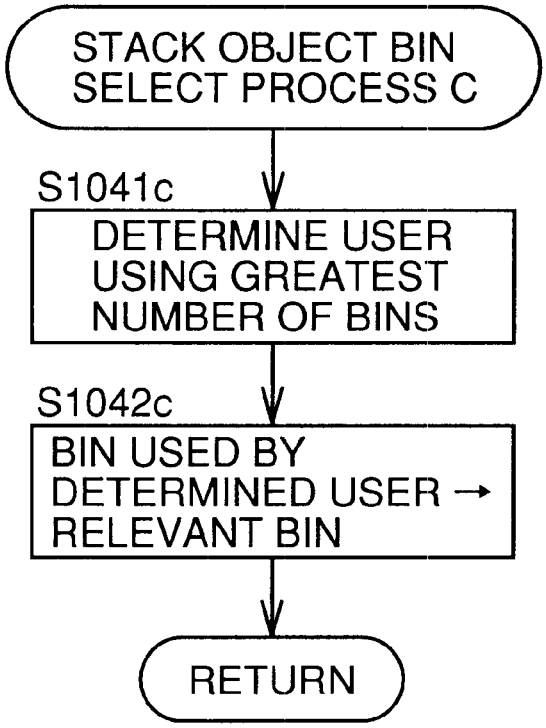

FIG. 19 is a flow chart of a stack object bin select process C. Here, the bin on which a sheet is discharged by the user using the greatest number of bins is selected as the bin to be subjected to a stack operation.

At S1041*c*, the user using the greatest number of bins is determined according to "user ID" (refer to FIG. 15) in the bin information management table. Then, the bin used by the user determined at S1041*c* is selected as the relevant bin. Following these processes, the present routine ends.

When there is a bin selected as the relevant bin in stack object bin select process C, the sheet on the relevant bin is taken as the object of a stack operation (S106 of FIG. 16). By the stack operation corresponding to one user, more bins can be made available.

Figure 20:
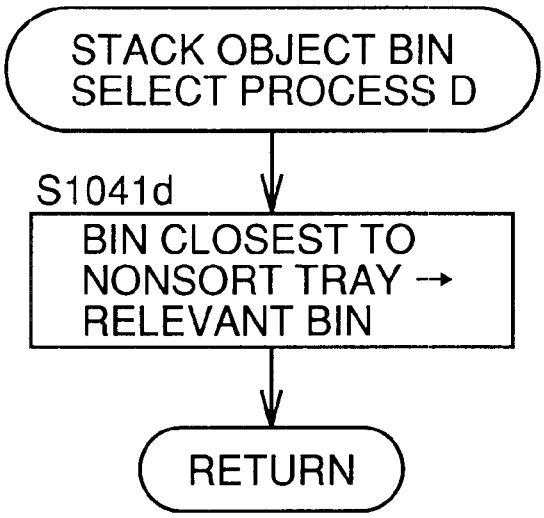

FIG. 20 is a flow chart of a stack object bin select process D. The bin located closest to the nonsort tray is selected as the bin to be subjected to a stack operation.

At S1041*d*, the bin closest to the nonsort tray is selected as the relevant bin. Then, the present routine ends. Here, the nonsort tray is located above or below the bin assembly. The closest bin differs according to the position of the nonsort tray.

When there is a bin selected as the relevant bin in stack object bin select process D, the sheet on the relevant bin is taken as the object of a stack operation (S106 of FIG. 16). The time required for a stack operation carried out by interrupting a print operation can be reduced.

Figure 21:
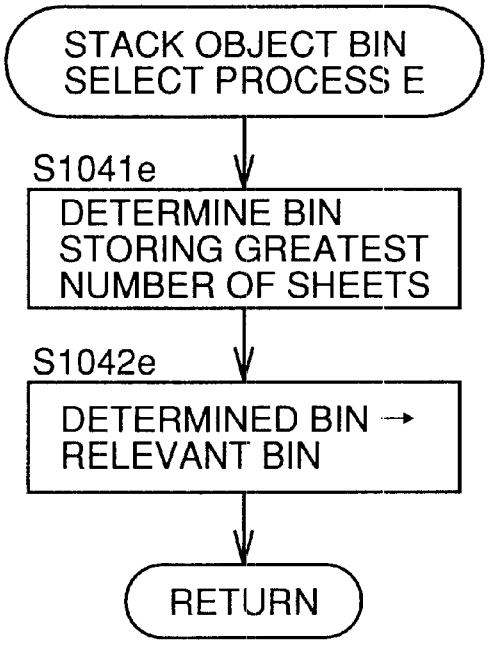

FIG. 21 is a flow chart of a stack object bin select process E. Here, the bin storing the greatest number of sheets is selected as the bin subjected to a stack operation.

At S1041*e*, the bin storing the maximum number of sheets is determined according to "output number" (refer to FIG. 15) in the bin information management table. At S1042*e*, the bin determined at S1041*e* is selected as the relevant bin. Following these processes, the present routine ends.

If there is a bin selected as the relevant bin in stack object bin select process E, the sheet on the relevant bin is taken as the object of a stack operation (S106 of FIG. 16). The image forming system using this stack object bin select process E can be improved in convenience by setting beforehand the jobs of the same user to be output on the same bin.

Figure 22:
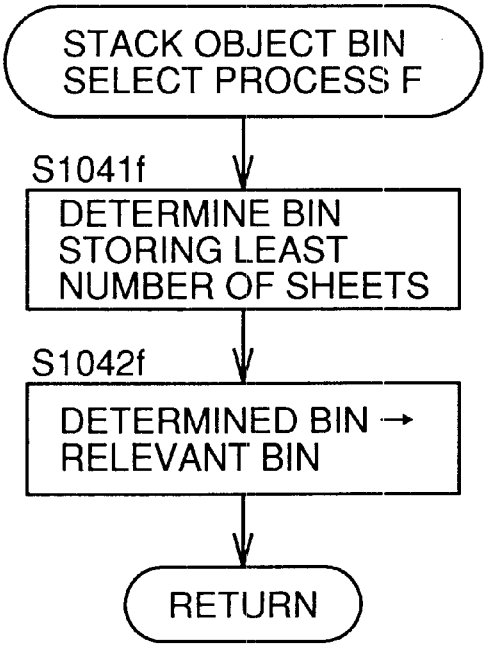

FIG. 22 is a flow chart of a stack object bin select process F. The bin storing the least number of sheets is selected as the bin of a stack operation.

At S1041*f*, the bin storing the least number of sheets is determined according to "output number" (refer to FIG. 15) in the bin information management table. At S1042*f*, the bin determined at S1041*f* is selected as the relevant bin. Following these processes, the present routine ends.

If there is a bin selected as the relevant bin in stack object bin select process F, the sheet on the relevant bin is taken as the object of the stack operation (S106 of FIG. 16). An image forming system using stack object bin select process F is advantageous in the case where the remaining capacity of the nonsort tray is small when an empty bin is selected for output irrelevant to the user.

Figure 23:
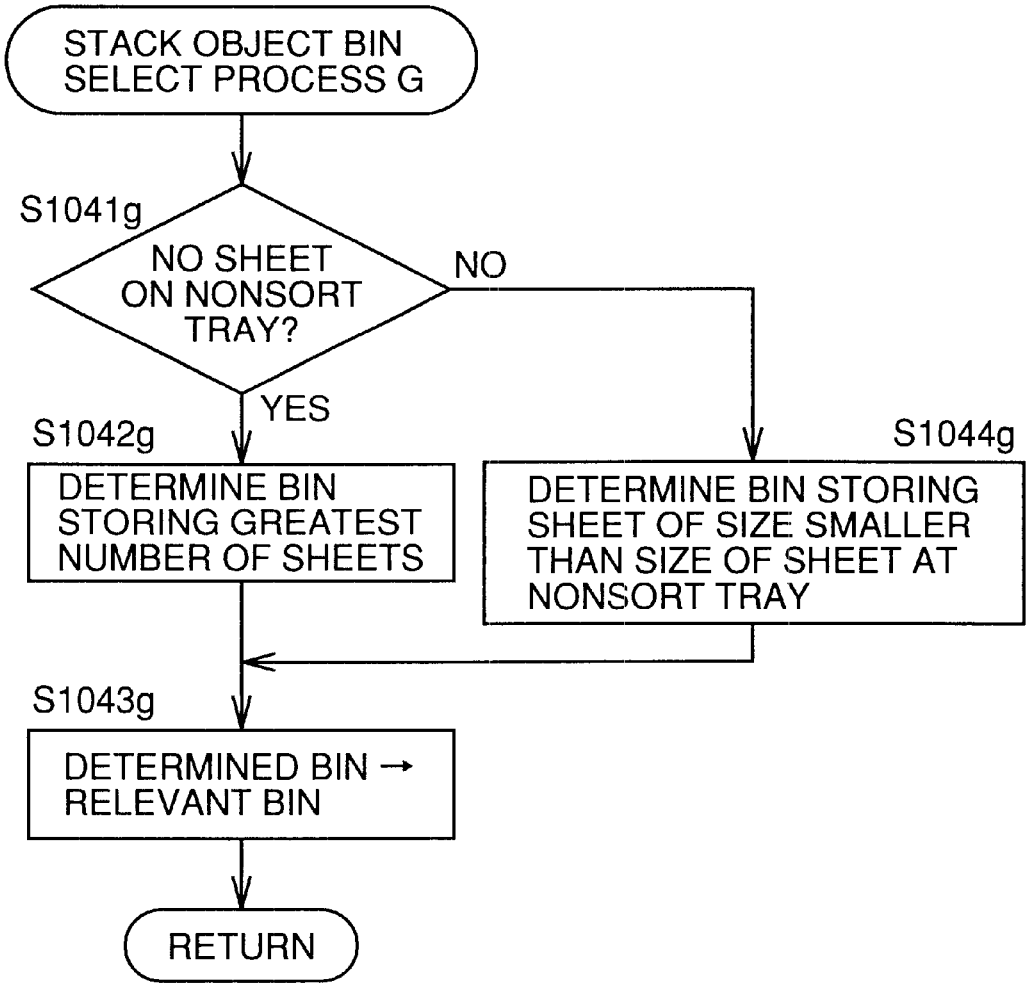

FIG. 23 is a flow chart showing a stack object bin select process G. As the bin to be subjected to a stack operation, the bin is selected on which a sheet of the largest size is discharged when no sheet is discharged on the nonsort tray, and the bin on which a sheet is discharged of a size smaller than the size of the sheet discharged on the nonsort tray, if any. At S1041*g*, determination is made whether there is no sheet on the nonsort tray. When there is no sheet on the nonsort tray (YES at S1041*g*), the bin storing the largest sheet that can be discharged to the nonsort tray is determined according to "sheet size" (refer to FIG. 15) in the bin information management table. When there is a sheet on the nonsort (NO at S1041*g*), the bin storing a sheet of a size smaller than the size of the sheet already discharged on the nonsort tray is determined according to "sheet size" (refer to FIG. 15) in the bin information management table. Then, the bin determined at S1043*g* is selected as the relevant bin. Following these processes, the present routine ends.

When there is a bin selected as the relevant bin in stack object bin select process G, the sheet on the relevant bin is taken as an object of the stack operation (S106 of FIG. 16). Here, the sheets transported onto the nonsort tray are overlaid from a larger to smaller size upwards.

This facilitates the sorting of each bundle of sheets without any complex structure such as shifting the sheets on the nonsort tray.

Figure 24:
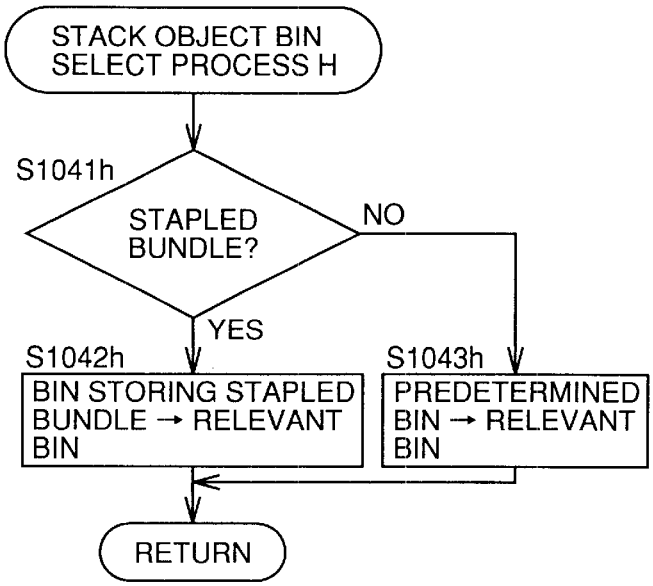

FIG. 24 is a flow chart of a stack object bin select process H. Here, the bin storing stapled sheets is selected as the bin to be subjected to a stack operation.

At S1041*h*, determination is made whether any of the plurality of bins store stapled bundle of sheets according to "Staple State" (refer to FIG. 15) in the bin information management table. When there is no bin storing stapled sheets (NO at S1041*h*), control proceeds to S1043*h* where a predetermined bin (for example, the top most bin) is selected as the relevant bin. Then, the present routine ends. When there is a bin storing stapled sheets (YES at S1041*h*), the bin determined at S1042*h* is selected as the relevant bin. Then, the present routine ends.

Figure 25:
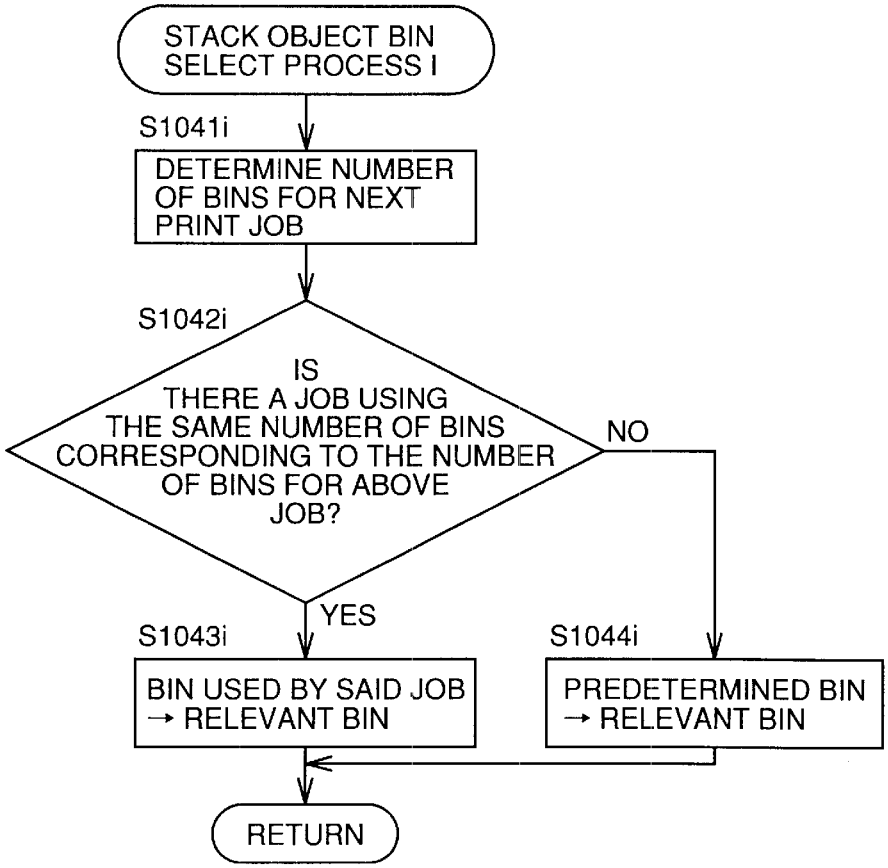

By selecting a bin that stores stapled sheets as the relevant bin to be subjected to a stack operation (S106 of FIG. 16) in stack object bin select process H, the bundle of sheets on the nonsort tray can be sorted easily distinguishing between the bundle of sheets without a complicated structure such as shifting stapled sheets on the nonsort tray. FIG. 25 is a flow chart showing a stack bin select process I. Here, the bin of a job using a number of bins identical in number to the bin that will be used by the job predetermined for the next printing is selected as the bin to be subjected to a stack operation.

At S1041*i*, the number of bins to be used by the job in the next print operation is determined according to "job ID" (refer to FIG. 15) in the bin information management table. At S1042*i*, determination is made whether there is a job that uses a number of bins identical in number to the number of bins determined at S1041*i*. When there is no job using the same number of bins (NO at S1042*i*), a predetermined bin (for example, the top most bin) determined at S1044*i* is selected as the relevant pin. Then, the present routine ends. When there is a job using the same number of bins (YES at S1042*i*), the bin of the job using the same number of bins is selected as the relevant bin at S1043*i*. Then, the present routine ends.

By selecting the bin corresponding to the job using a number of bins identical in number to that to be used by the job of the next print operation for a stack operation (S106 of FIG. 16) in stack object bin select process I, the sheets on the bin least used by the jobs will be transported onto the nonsort tray. The time required for a stack operation by interrupting a print operation can be reduced.

By employing stack object bin select processes A–I of FIGS. 17–25 for S104 of FIG. 16, the above-described advantages can be achieved. Also, a bin on which a sheet is not placed is prearranged, so that a sheet corresponding to a new job can be discharged on the prearranged bin. The problem of an output sheet corresponding to a new job being mixed up at the discharge unit is eliminated. The user operability can be improved.

Third Embodiment

An image forming system according to a third embodiment of the present invention will be described. The image forming system of the third embodiment differs from the image forming system of the first embodiment in the control procedure of the staple sorter described with reference to FIGS. 12 and 13, likewise the image forming system of the second embodiment. The remaining elements of the third embodiment is similar to that of the image forming system of the first embodiment.

According to the staple sorter of the image forming system of the third embodiment, a user information management table shown in FIG. 26 is produced by the CPU controlling the staple sorter. This table is stored in a RAM connected to this CPU. Control according to the flow chart of FIG. 27 is carried out using the table.

Referring to the user information management table of FIG. 26, "discharge set bin" is specified corresponding to "user ID". "Discharge set bin" specifies a plurality of bins provided at the staple sorters such as the above bins 311–315, and is fixedly assigned to a user. According to the user information management table, discharge set bin 3 is set so as to be shared by the users of user ID2 and user ID3.

In the present staple sorter, control is executed as set forth in the following using the user information management table and the user ID corresponding to a bin in the bin information management table shown in FIG. 15.

Figure 27:
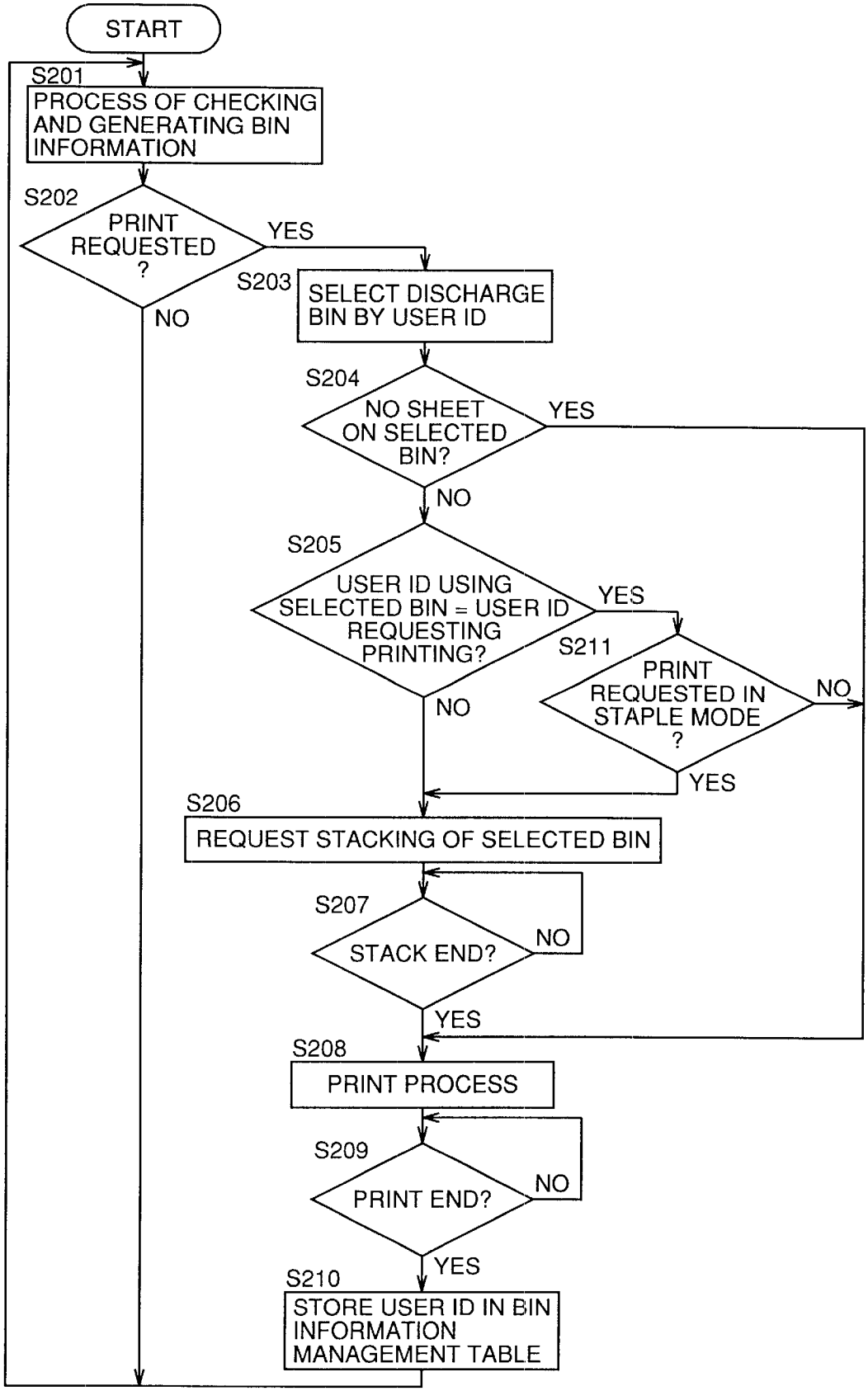
FIG. 27 is a flow chart showing a control procedure of the CPU that controls the staple sorter.

FIG. 27 is a flow chart showing the control procedure of the CPU controlling the present staple sorter.

When the power is turned on and the program initiated, the user information is checked at S201 by the present staple sorter. A user information management table as shown in FIG. 26 is generated. At S202, determination is made whether a print process request has been detected or not from the CPU providing control of the digital copy machine to which the present staple sorter is connected.

When a print process request is not detected (NO at S202), control proceeds to S201. When a print process request is detected (YES at S202), control proceeds to S203 to select the bin in which a sheet is discharged by the user ID according to the user information management table (refer to FIG. 26).

At S204, determination is made whether there is a sheet on the bin selected at S203. When there is a sheet on the selected bin (NO at S204), control proceeds to S205 to detect whether the user ID of the user corresponding to the selected bin (allocated bin) is identical to the user ID of the user requesting a print operation.

When the user ID of the user corresponding to the selected bin is not identical to the user ID of the user requesting a print operation (NO at S205), control proceeds to S206 to initiate a stack operation for the sheet placed on the selected bin. At S207, determination is made whether the stack operation has ended or not. When the stack operation has not yet ended (NO at S207), control remains at S207. When the stack operation ends (YES at S207), control proceeds to the process of S208.

At S208, a signal requesting initiation of a print process is sent to the CPU providing control of the digital copy machine. At S209, determination is made whether the print process has ended or not. When the print process has not yet ended (NO at S209), control remains at S209. When the print process ends (YES at S209), control proceeds to S210 to store the user ID of the user using the bin into the bin information control table. Then, control returns to S201 to initiate the process from the beginning.

When the user ID of the user using the selected bin is identical to the user ID of the user requesting the print operation (YES at S205), control proceeds to S211 to determine whether a staple process is specified for the sheet corresponding to the print request. When setting is not made of a staple process (NO at S211), control proceeds to the print process of S208. When a staple process is set (YES at S211), control proceeds to the select bin stack request of S206.

When there is no sheet on the selected bin (YES at S204), control proceeds to the print process of S208.

Accordingly, when there is no sheet discharged at the bin assigned for each user (specified bin) in carrying out a new print operation, the sheet is discharged to the specified bin. When there is a sheet already in the specified bin, the sheet is discharged in an overlying manner at the specified bin when the sheet already discharged is of the same user, provided that the sheets are not stapled. When the sheet already discharged is of a different user or when the sheets are stapled, the sheets on the specified bin are transferred to the nonsort tray in a bundle.

Thus, a bin in which a sheet is not placed is prearranged, and a sheet corresponding to a new job is discharged onto the prearranged bin. A sheet discharged corresponding to a new job will not be mixed up at the discharge unit. Therefore, the operability of the user is improved.

Fourth Embodiment

According to a fourth embodiment of the present invention, a bin information management table as shown in FIG. 28 is generated by CPU 170 and stored in RAM 172. By using this bin information management table, the ID number of a job corresponding to the sheet output to the bin and capacity overflow of the bin can be controlled.

Referring to the bin information management table of FIG. 28, "bins 1–5" correspond to aforementioned bins 311–315 (refer to FIG. 4), respectively. "Nonsort tray" corresponds to nonsort tray 20. "Number of sheets" records the total number of sheets placed on nonsort tray 20 and each of bins 311–315.

"Job ID" stores the ID indicating which job corresponds to the sheet discharged at each of nonsort tray 20 and bins 311–315. For example in FIG. 28, the job ID for all of bins 3–5 is "3". This means that the sheets resulting from the execution of a copy operation with a sort operation (one job) are output to bins 3–5. Bins 1 and 2 have the job ID of "1" and "2", respectively. This indicates that sheets discharged by different jobs are placed therein.

Figure 29A:
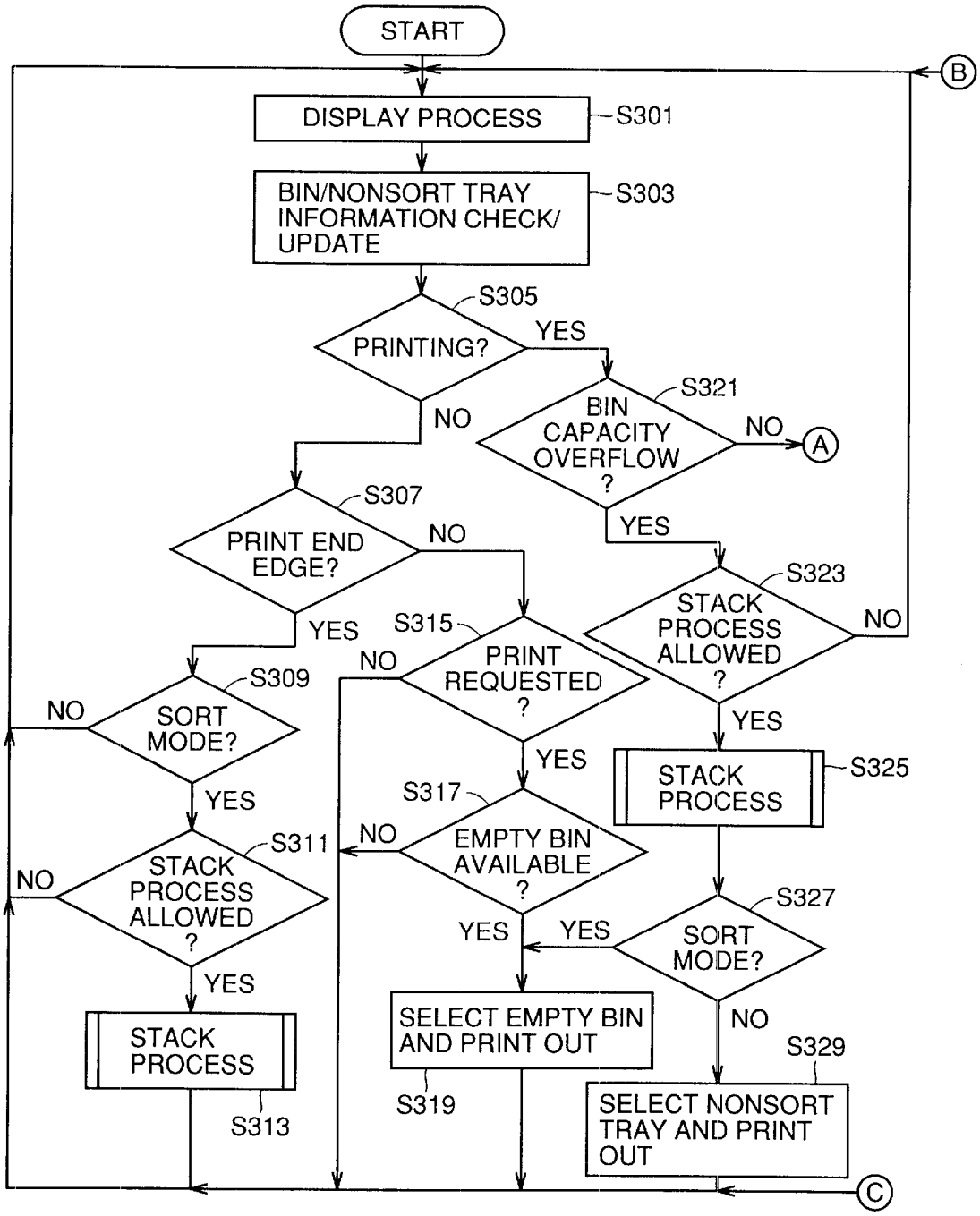
FIGS. 29A and 29B are flow charts of the process of the CPU of the fourth embodiment.
Figure 29B:
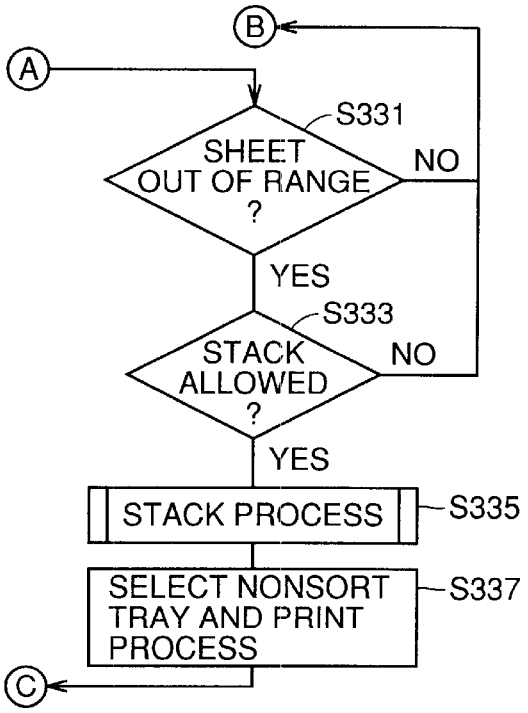

FIGS. 29A and 29B are flow charts showing the control process of staple sorter 10 by CPU 170 according to the fourth embodiment.

Referring to FIGS. 29A and 29B, a display process corresponding to touch panel 151 (refer to FIG. 3) is carried out at S301. The process is carried out of displaying which tray contains the output of the sheet corresponding to a job carried out by a user, and displaying a message indicating the divided output of the sheets of one job to nonsort tray 20 and bins 311–315.

At S303, the check and update of the information in the bin information management table of FIG. 28 are carried out. At S305, determination is made whether a print operation is currently carried out by digital copy machine 200. When NO at S305, control proceeds to S307 to determine whether the print end edge is output from CPU 173. Here, the print end edge is a signal output immediately after completion of a print operation by digital copy machine 200.

When YES at S307, control proceeds to S309 to determine whether the sort mode is selected by the user or not. Here, a sort mode is the mode to sort the output by one job into bins 311–315. For example, when the user sets a sort mode for one group of documents and "3" as the required number of copies, three set of copied sheets are distributed into different bins.

When YES at S309, control proceeds to S311 to determine whether a stack operation for the nonsort tray is possible or not by checking the column of the nonsort tray in the bin information management table. For example, S111 provides the determination of NO when the number of sheets placed on the nonsort tray exceeds the permitted number of sheets of the nonsort tray.

When YES at S311, control proceeds to S313 to carry out the process of transferring and stacking the group of sheets output from bins 311–315 to nonsort tray 20. Following the process of S313, control returns to S301.

When NO at S309 or S311, control returns to S301.

When NO at S307, control proceeds to S315 to determine whether there is a print request from CPU 173. When YES at S315, the bin information management table is referred to at S317 to determine whether there is an empty bin (a bin having the number of sheets of 0). When YES at S317, control proceeds to S319 to select that empty bin. A print process of discharging a sheet to the empty bin is carried out. Following the process of S319, control returns to S101.

When NO at S315 or S317, control directly returns to S301.

When YES at S305, control proceeds to S321 to determine whether the bin with the sheet output exceeds the capacity or not. Determination is made by referring to the bin information management table to check whether the number of sheets corresponding to that bin has exceeded a standard value or not.

When YES at S321, control proceeds to S323 to determine whether a stack process for nonsort tray 20 is allowed or not.

When YES at S323, control proceeds to S325 to carry out the process of transferring and stacking the bundle of sheets in the bin determined to have exceeding capacity to nonsort tray 20.

Following the process of S325, control proceeds to S327 to determine whether the sort mode is selected or not. When NO at S327, nonsort tray 20 is selected as the output destination of the sheet. A printing operation and an output process are resumed. Then, control returns to S101.

When YES at S327, control proceeds to S319 to select an empty bin. Then, a print operation is resumed.

When NO at S323, control returns to S301.

When NO at S321, control proceeds to S331 to determine whether a sheet that cannot be output to the bin (a sheet outside the output range) has been transported or not. When YES at S331, control proceeds to S333 to determine whether a stack process is allowed for nonsort tray 20.

When YES at S333, control proceeds to S335 to carry out the process of transferring and stacking the sheets on the bin to nonsort tray 20. At S337, nonsort tray 20 is selected as the output destination of the sheet. In the subsequent print process, the sheets are output to nonsort tray 20. Then, control returns to S301.

When NO at S331 or S333, control returns to S301.

Figure 30:
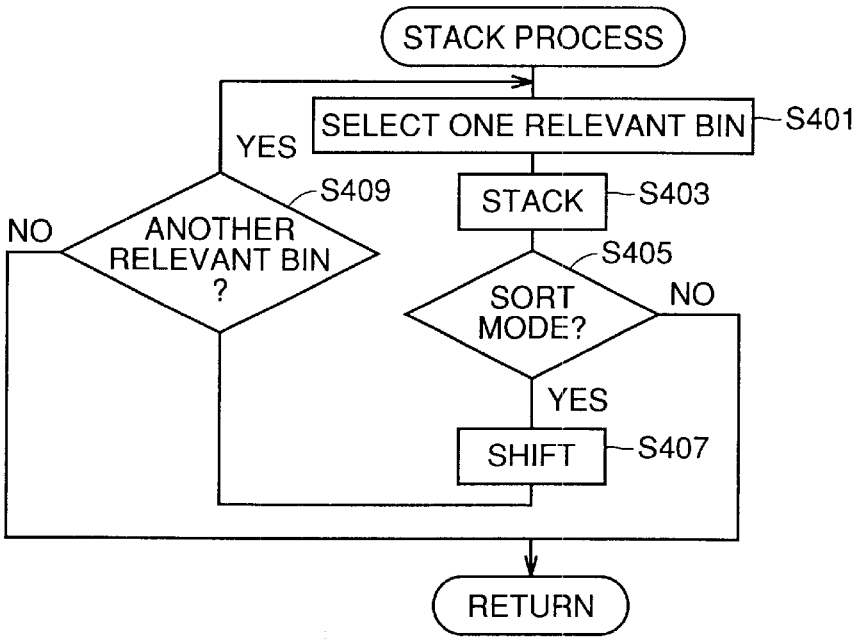
FIG. 30 is a flow chart showing a subroutine of a stack process in the fourth embodiment.

FIG. 30 shows the flow chart of the procedure carried out by the stack process (S313, S325, S335).

Referring to FIG. 30, one bin that is to be subjected to a stack operation is selected at S401. More specifically, this is the bin to which the printed sheet is output at step S313, the bin with the exceeded capacity in the stack process of S325, or the bin to which an out-of-range sheet is output in the stack process of S135.

At S403, transportation and stacking of a bundle of sheets from the selected bin to nonsort tray 20 is carried out. At S405, determination is made whether the sort mode is selected or not. When YES at S405, an operation of shifting the sheet output position is carried out by a nonsort tray shift unit 20A shown in FIGS. 31 and 32. Then, determination is made whether there is another bin to be subjected to a stack operation at S209. When YES at S209, the process from S201 is repeated.

When NO at S405 or S409, control returns to the main routine.

Figure 31:
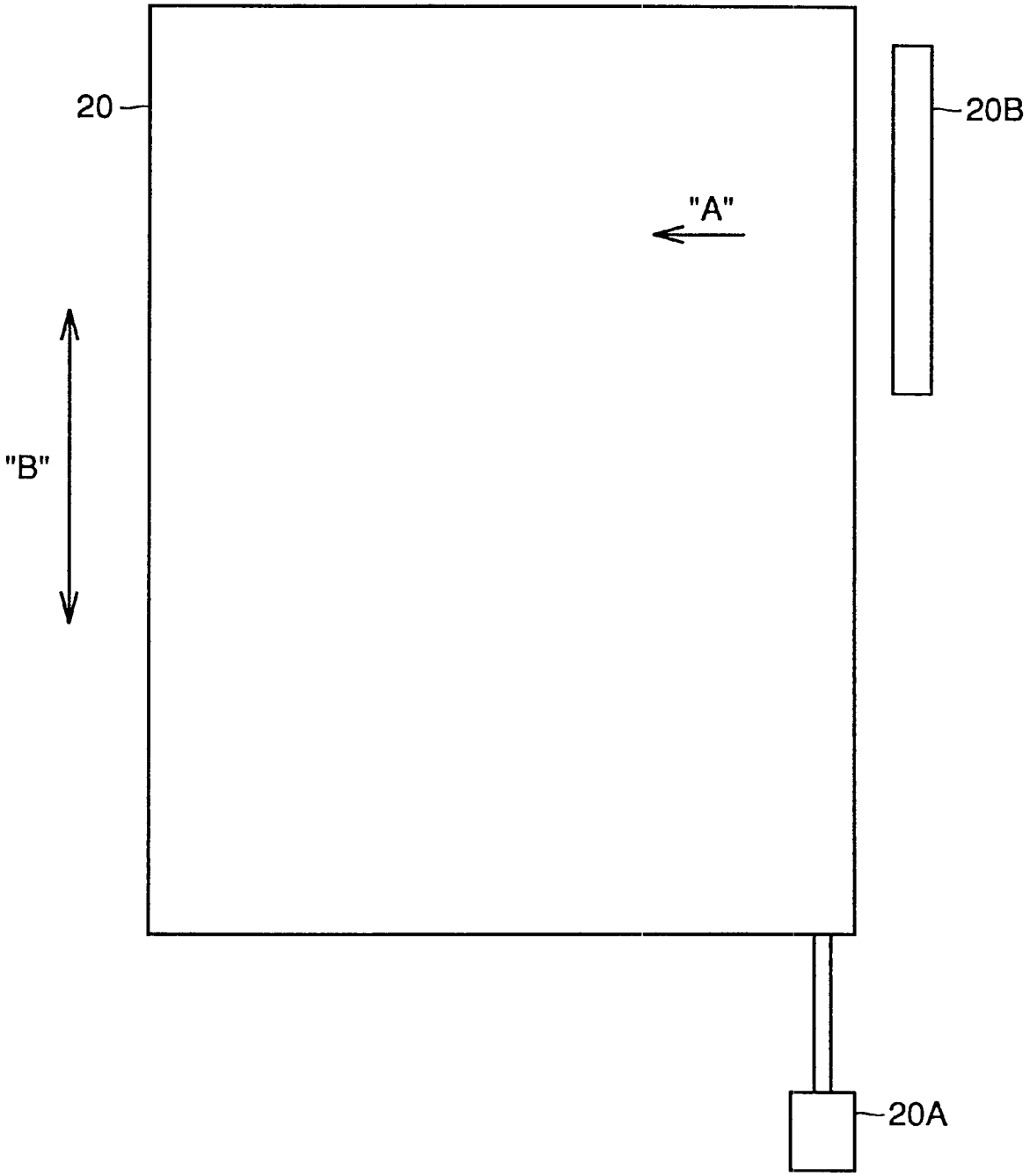
FIG. 31 is a diagram to describe a mechanism of shifting a nonsort tray.
Figure 32:
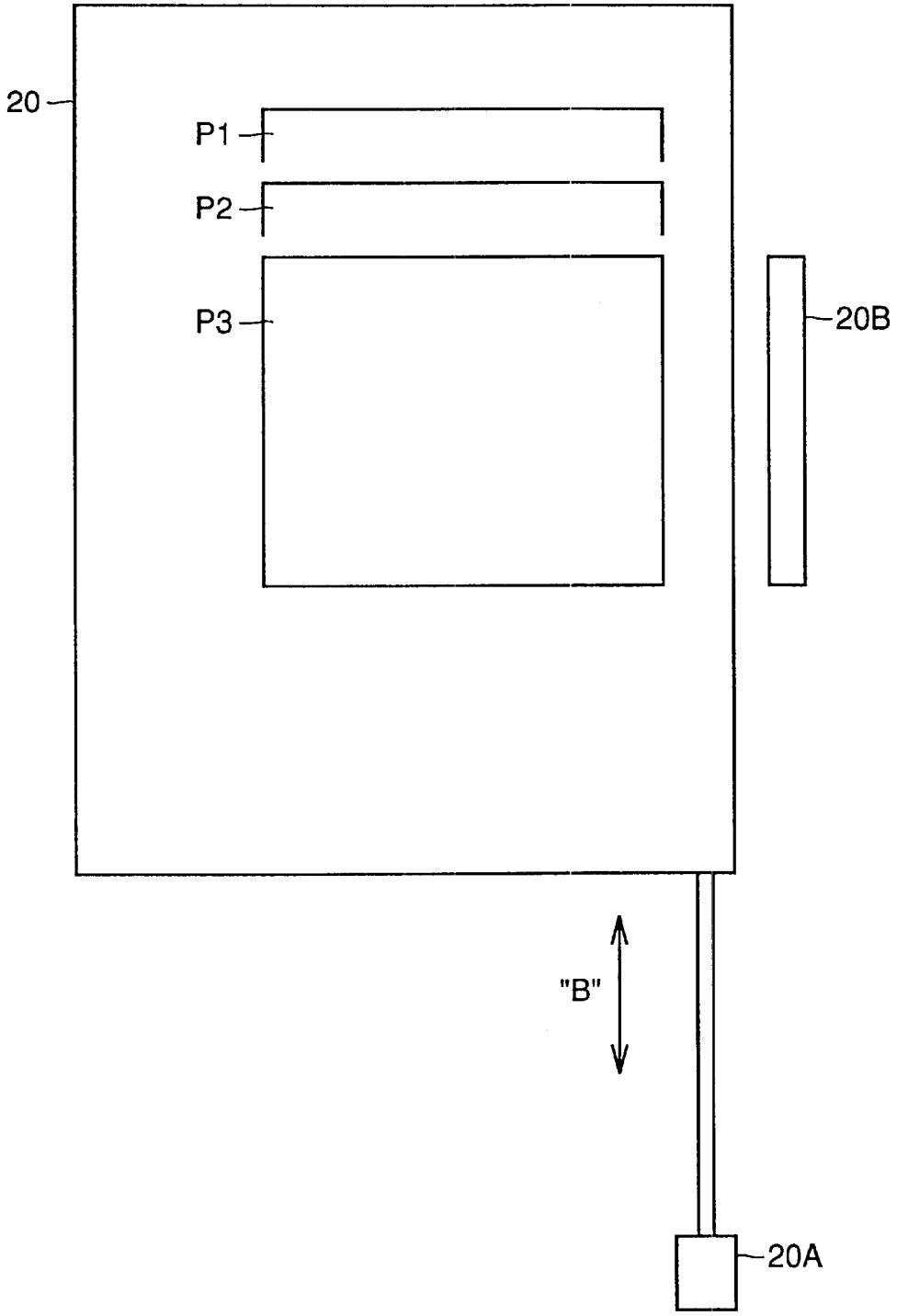
FIG. 32 shows a shifted state of the nonsort tray.

FIG. 31 is a plan view to describe the shifting mechanism of shifting the sheet discharge position of nonsort tray 20. The sheet is discharged from a sheet discharge outlet 20B in the direction of "A" on nonsort tray 20. Nonsort tray shift unit 20A moves nonsort tray 20 in the direction of "B". After one bundle of sheets (or a bundle of sheets for one job) are discharged from sheet discharge outlet 20B, nonsort tray shift unit 20A moves nonsort tray 20 upwards in the drawing by a predetermined pitch. Then, a new bundle of sheets are discharged from sheet discharge outlet 20B.

By repeating the above operation, bundle of sheets P1–P3 are placed on nonsort tray 20 in respective offset positions. Therefore, the user can easily identify one bundle of sheets from another bundle of sheets.

By the above processes, an operation set forth in the following is realized.

[When Nonsort Mode is Selected]:

(1) In a print operation, generally one bin is selected and a sheet is output to that bin. A stack operation to the nonsort tray is not carried out following the completion of the print operation (NO at S309).

(2) When the capacity of the bin is exceeded during a print operation, the sheet is transferred from that bin to the nonsort tray when a stack operation is allowed (S325). Then, the output of a sheet towards the nonsort tray is resumed (S329). Accordingly, the sheets will not be output in a diversed manner among the nonsort tray and the bin.

[When Sort Mode is Selected]

(1) A plurality of bins are selected in the print operation. Sheets are classified and output to these bins.

(2) When the print operation ends and a stack process is allowed, the sheet output to the bin is transferred to the nonsort tray to be stacked (S313). Here, the nonsort tray is shifted for each bin (S407). Therefore, the user can easily identify a bundle of sheets from another bundle of sheets.

(3) When the bin capacity is exceeded during a print operation and a stack process is allowed, the output to that bin is transferred and stacked to the nonsort tray (S325). Here, the nonsort tray is shifted for each bin (S407). Therefore, the user can easily identify a bundle of sheets from another bundle of sheets.

Then, an empty bin is selected and output of a sheet towards that bin is resumed (S319). When the output ends, the sheets are stacked (S313).

When a stack process cannot be carried out, a message can be displayed on touch panel 151 informing that the sheet output to the bin by the resumed output is left in the bin, and the sorted sheets are stored in nonsort tray 20 and a particular bin in bin assembly 30.

[When Nonsort Mode or Sort Mode is Selected]

When a stack process is allowed in the event of a sheet that cannot be output to the bin (for example, a sheet that is too great in size) is delivered, the sheet output to that bin is stacked at the nonsort tray (S335). Then, the subsequent output to that bin is carried out towards the nonsort tray (S337). Accordingly, the process will not be interrupted even when a sheet that cannot be output to the bin is delivered. Also, the divided output of a sheet to a bin and to the nonsort tray can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet processing device which processes sheets discharged from said image forming apparatus executing a print job, comprising:

a memory which stores identification information of a user requesting a job corresponding to each job, a first discharge tray, a plurality of second discharge trays, a transport unit which transports a bundle of sheets discharged on said second discharge trays to said first discharge tray, and a controller which controls said transport unit so as to transport from said second discharge tray a bundle of sheets by a previous job when a user of a new job differs from the user of the previous job in discharging a sheet by the new job to said second discharge tray already storing a sheet by the previous job.

2. The sheet processing device according to claim 1, further comprising a stapler, wherein said controller controls said transport unit so as to transport a bundle of sheets by the previous job from said second discharge tray when the user of said new job is identical to the user of said previous job, and a staple process is to be applied on the bundle of sheets by the new job.

3. An image forming system including a sheet processing device and an image forming apparatus, said sheet processing device comprising:

a memory which stores identification information of a user requesting a job corresponding to each job, a first discharge tray, a plurality of second discharge trays, a transport unit which transports a bundle of sheets discharged on said second discharge trays to said first discharge tray, and a controller which controls said transport unit so as to transport from said second discharge tray a bundle of sheets by a previous job when a user of a new job differs from the user of the previous job in discharging a sheet by the new job to said second discharge tray already storing a sheet by the previous job.

4. A sheet discharge method of a sheet processing device including a transport unit transporting a bundle of sheets from a plurality of second discharge trays to a first tray, said method comprising the steps of:

selecting at least one second discharge tray from a plurality of second discharge trays, discharging a first bundle of sheets to said selected second discharge tray, determining whether a second bundle of sheets correspond to a user of said first bundle of sheets, transporting the first bundle of sheets from said second discharge tray to said first tray when determination is made of the same user, and discharging the second bundle of sheets to said selected second discharge tray after the end of transportation.

* * * * *